US007462403B2

(12) United States Patent
Hidaka et al.

(10) Patent No.: US 7,462,403 B2
(45) Date of Patent: Dec. 9, 2008

(54) R-T-B SYSTEM PERMANENT MAGNET

(75) Inventors: Tetsuya Hidaka, Tokyo (JP); Hironari Okada, Tokyo (JP); Kazuya Sakamoto, Tokyo (JP); Takeshi Sakamoto, Tokyo (JP); Yasuyuki Nakayama, Tokyo (JP); Tomomi Yamamoto, Tokyo (JP)

(73) Assignee: TDK Corporation, Tokyo (JP)

( * ) Notice: Subject to any disclaimer, the term of this patent is extended or adjusted under 35 U.S.C. 154(b) by 316 days.

(21) Appl. No.: 10/562,986

(22) PCT Filed: Jun. 24, 2004

(86) PCT No.: PCT/JP2004/009262

§ 371 (c)(1),
(2), (4) Date: Dec. 27, 2005

(87) PCT Pub. No.: WO2005/001855

PCT Pub. Date: Jan. 6, 2005

(65) Prior Publication Data

US 2007/0102069 A1 May 10, 2007

(30) Foreign Application Priority Data

| | | |
|---|---|---|
| Jun. 27, 2003 | (JP) | 2003-185120 |
| Sep. 3, 2003 | (JP) | 2003-311811 |
| Sep. 3, 2003 | (JP) | 2003-311812 |
| Sep. 25, 2003 | (JP) | 2003-334193 |

(51) Int. Cl.
*H01F 1/057* (2006.01)

(52) U.S. Cl. ..... 428/611; 148/302

(58) Field of Classification Search ..... None
See application file for complete search history.

(56) References Cited

U.S. PATENT DOCUMENTS 5,858,123 A 1/1999 Uchida et al.

(Continued)

FOREIGN PATENT DOCUMENTS

| | | |
|---|---|---|
| EP | 0 753 867 | 8/2002 |
| JP | 09-027409 A | 1/1997 |
| JP | 09-260122 A | 10/1997 |
| JP | 11-273922 | 10/1999 |

(Continued)

OTHER PUBLICATIONS

English translation of Chinese language office action issued in corresponding Chinese application No. 200480015078.5.

*Primary Examiner*—John P. Sheehan
(74) *Attorney, Agent, or Firm*—Hogan & Hartson LLP

(57) ABSTRACT

An R-T-B system permanent magnet 1 comprises a magnet body 2 comprising a sintered body comprising at least a main phase comprising $R_2T_{14}B$ grains (wherein R represents one or more rare earth elements, and T represents one or more transition metal elements including Fe or Fe and Co essentially) and a grain boundary phase containing R in a larger amount than the main phase, the magnet body 2 having a 300 μm or less thick (not inclusive of zero thick) hydrogen-rich layer 21 having a hydrogen concentration of 300 ppm or more formed in the surface layer portion, and an overcoat 3 covering the surface of the magnet body 2 can improve the corrosion resistance of the R-T-B system permanent magnet 1 with an overcoat 3 formed thereon without degrading the magnetic properties thereof. The present invention can be applied to formation of the overcoat 3 by electrolytic plating, can fully ensure the corrosion resistance as a primary target of the overcoat 3 formation without substantially degrading the production efficiency, and can provide the R-T-B system permanent magnet 1 with a high dimensional precision by suppressing the partial collapse (detachment of grains) of the surface thereof.

11 Claims, 18 Drawing Sheets

U.S. PATENT DOCUMENTS

| | | | | |
|---|---|---|---|---|
| 5,997,804 | A | 12/1999 | Uchida et al. | |
| 6,080,245 | A | 6/2000 | Uchida et al. | |
| 6,254,694 | B1 * | 7/2001 | Hasegawa et al. | 148/101 |
| 2003/0172995 | A1 * | 9/2003 | Makita et al. | 148/101 |
| 2004/0188267 | A1 * | 9/2004 | Sakamoto et al. | 205/181 |

FOREIGN PATENT DOCUMENTS

| | | | |
|---|---|---|---|
| JP | 2001-135511 | A | 5/2001 |
| JP | 2001-210504 | | 8/2001 |
| JP | 2002-105690 | A | 4/2002 |

* cited by examiner

FIGURE 4

| | Nd (wt%) | Pr (wt%) | Dy (wt%) | Tb (wt%) | B (wt%) | Al (wt%) | Co (wt%) | Cu (wt%) | Zr (wt%) | Nb (wt%) | N (ppm) | O (ppm) | C (ppm) | Fe |
|---|---|---|---|---|---|---|---|---|---|---|---|---|---|---|
| Composition A | 24.5 | 5.5 | — | — | 1.0 | 0.2 | 0.5 | 0.05 | — | — | 330 | 1520 | 290 | bal. |
| Composition B | 25.0 | 5.5 | — | — | 1.0 | 0.2 | 0.5 | 0.05 | 0.15 | — | 400 | 1010 | 200 | bal. |
| Composition C | 20.0 | 5.5 | 5.0 | — | 1.0 | 0.25 | 0.5 | 0.10 | — | — | 420 | 1800 | 490 | bal. |
| Composition D | 22.0 | — | 7.5 | — | 1.0 | 0.25 | 0.5 | 0.07 | — | 0.7 | 310 | 1640 | 710 | bal. |
| Composition E | 24.5 | 5.5 | - | — | 1.0 | 0.2 | 0.5 | 0.05 | 0.05 | — | 410 | 1220 | 310 | bal. |
| Composition F | 24.5 | 5.5 | - | — | 1.0 | 0.2 | 0.5 | 0.05 | 0.30 | — | 480 | 1150 | 350 | bal. |
| Composition G | 20.0 | 5.5 | 5.0 | — | 1.0 | 0.2 | 0.5 | 0.05 | — | 0.2 | 440 | 1430 | 320 | bal. |
| Composition H | 20.0 | 5.5 | 5.0 | — | 1.0 | 0.2 | 0.5 | 0.05 | — | 1.5 | 350 | 1090 | 290 | bal. |
| Composition I | 20.0 | 5.5 | 5.0 | — | 1.0 | 0.2 | 0.5 | 0.05 | — | 2.3 | 390 | 1310 | 380 | bal. |
| Composition J | 28.5 | — | 1.0 | 1.0 | 1.0 | 0.25 | 0.5 | 0.10 | — | — | 390 | 810 | 350 | bal. |

FIGURE 5

| Sample No. | Alloy composition | Evaluation of corrosion resistance | | Magnetic properties | | | $R_2Fe_{14}B$ grain | |
|---|---|---|---|---|---|---|---|---|
| | | Thickness of hydrogen-rich layer [μm] | Corrosion resistance | Br [T] | HcJ [kA/m] | Hk/Hc j [%] | 10 μm or less [%] | 20 μm or more [%] |
| 1 | Composition A | 0 | 5/100 | 1.473 | 907 | 96.0 | 92 | 1 |
| 2 | | 20 | 0/100 | | | | | |
| 3 | | 40 | 0/100 | | | | | |
| 4 | | 100 | 1/100 | | | | | |
| 5 | | 160 | 2/100 | | | | | |
| 6 | | 200 | 2/100 | | | | | |
| 7 | | 250 | 4/100 | | | | | |
| 8 | | 300 | 5/100 | | | | | |
| 9 | Composition B | 45 | 0/100 | 1.460 | 945 | 97.5 | 97 | 0 |
| 10 | Composition C | 20 | 0/100 | 1.431 | 2020 | 96.2 | 93 | 1 |
| 11 | Composition D | 22 | 0/100 | 1.220 | 2325 | 98.3 | 95 | 0 |
| 12 | Composition E | 40 | 0/100 | 1.475 | 879 | 94.9 | 94 | 1 |
| 13 | Composition F | 20 | 0/100 | 1.461 | 922 | 92.8 | 97 | 0 |
| 14 | Composition G | 20 | 0/100 | 1.324 | 2040 | 96.7 | 94 | 0 |
| 15 | Composition H | 20 | 0/100 | 1.297 | 2115 | 97.3 | 96 | 0 |
| 16 | Composition I | 20 | 0/100 | 1.259 | 2190 | 97.3 | 98 | 0 |
| 17 | Composition J | 50 | 0/100 | 1.424 | 1405 | 98.1 | 94 | 0 |

FIGURE 6

| Sample No. | Nd (wt%) | B (wt%) | Al (wt%) | Co (wt%) | Cu (wt%) | Zr (wt%) | N (ppm) | O (ppm) | C (ppm) | Fe |
|---|---|---|---|---|---|---|---|---|---|---|
| 18 | 30.5 | 1.0 | 0.2 | 0.5 | 0.1 | 0.2 | 890 | 1200 | 640 | bal. |
| 19 | | | | | | | 100 | 850 | 850 | bal. |
| 20 | | | | | | | 1800 | 950 | 650 | bal. |
| 21 | | | | | | | 530 | 3000 | 850 | bal. |
| 22 | | | | | | | 650 | 780 | 1800 | bal. |
| 23 | 32.8 | | | | | | 780 | 890 | 870 | bal. |

FIGURE 7

| Sample No. | Evaluation of corrosion resistance | | Magnetic properties | | | $R_2Fe_{14}B$ grain | |
|---|---|---|---|---|---|---|---|
| | Thickness of hydrogen-rich layer [μm] | Corrosion resistance | Br [T] | HcJ [kA/m] | Hk/Hc j [%] | 10 μm or less [%] | 20 μm or more [%] |
| 18 | 50 | 0/100 | 1.451 | 925 | 97.6 | 96 | 0 |
| 19 | 50 | 6/100 | 1.450 | 954 | 97.4 | 95 | 0 |
| 20 | 50 | 0/100 | 1.443 | 868 | 92.0 | 92 | 0 |
| 21 | 50 | 0/100 | 1.432 | 825 | 91.1 | 93 | 0 |
| 22 | 50 | 0/100 | 1.443 | 903 | 96.7 | 94 | 0 |
| 23 | 50 | 9/100 | 1.349 | 1085 | 96.2 | 92 | 0 |

FIGURE 8

| Chemical composition | | | | | | | Magnetic properties | | |
|---|---|---|---|---|---|---|---|---|---|
| Nd (wt%) | Pr (wt%) | B (wt%) | Al (wt%) | Co (wt%) | Cu (wt%) | Fe | Br [T] | HcJ [kA/m] | Hk/Hc j [%] |
| 24.5 | 5.5 | 1.0 | 0.2 | 0.5 | 0.05 | bal. | 1.473 | 907 | 96 |

FIGURE 9

| Sample No. | Etching conditions | Plating conditions |
|---|---|---|
| 24 | 10% Nitric acid solution (40° C), 3 min. | Bath temp.: 55° C, 0.3 A/dm$^2$, 300 min. |
| 25 | 5% Nitric acid solution (40° C), 8 min. | Bath temp.: 40° C, 2.0 A/dm$^2$, 50 min. |
| 26 | 5% Nitric acid solution (40° C), 10 min. | Bath temp.: 50° C, 0.15 A/dm$^2$, 700 min. |
| 27 | 5% Nitric acid solution (40° C), 10 min. | Bath temp.: 60° C, 4.5 A/dm$^2$, 20 min. |
| 28 | 5% Nitric acid solution (40° C), 10 min. | Bath temp.: 40° C, 2.5 A/dm$^2$, 40 min. |

FIGURE 10

| Sample No. | Before barrel polishing treatment | | | After barrel polishing treatment | | | After acid etching | | | After plating treatment | | |
|---|---|---|---|---|---|---|---|---|---|---|---|---|
| | Dimension A | Dimension B | Dimension C | Dimension A | Dimension B | Dimension C | Dimension A | Dimension B | Dimension C | Dimension A | Dimension B | Dimension C |
| 24 | 0.004880 | 0.004737 | 0.003516 | 0.006165 | 0.004652 | 0.002759 | 0.005005 | 0.004105 | 0.002385 | 0.008062 | 0.005532 | 0.003904 |
| 25 | 0.003848 | 0.004478 | 0.003689 | 0.004936 | 0.004713 | 0.004051 | 0.004742 | 0.005138 | 0.003583 | 0.007836 | 0.006102 | 0.003437 |
| 26 | 0.004969 | 0.005277 | 0.003562 | 0.005389 | 0.004969 | 0.003138 | 0.008126 | 0.007778 | 0.007057 | 0.011073 | 0.009396 | 0.011250 |
| 27 | 0.004432 | 0.005845 | 0.004190 | 0.005528 | 0.004899 | 0.005445 | 0.006949 | 0.007273 | 0.007226 | 0.010519 | 0.009038 | 0.009860 |
| 28 | 0.004584 | 0.004477 | 0.004779 | 0.004919 | 0.006856 | 0.007772 | 0.005974 | 0.007798 | 0.008698 | 0.010909 | 0.009185 | 0.010268 |

FIGURE 11

| Dimension A (mm) | | | | |
|---|---|---|---|---|
| | Before barrel polishing treatment | After barrel polishing treatment | After acid etching treatment | After plating treatment |
| 1 | 6.002 | 5.993 | 5.971 | 6.005 |
| 2 | 5.991 | 5.977 | 5.964 | 5.983 |
| 3 | 5.990 | 5.975 | 5.981 | 6.004 |
| 4 | 6.005 | 5.992 | 5.972 | 5.986 |
| 5 | 5.995 | 5.982 | 5.974 | 6.006 |
| 6 | 6.003 | 5.989 | 5.977 | 5.991 |
| 7 | 5.997 | 5.986 | 5.965 | 6.003 |
| 8 | 5.999 | 5.987 | 5.970 | 5.994 |
| 9 | 5.994 | 5.994 | 5.976 | 5.989 |
| 10 | 6.001 | 5.988 | 5.975 | 5.999 |
| Average | 5.998 | 5.986 | 5.973 | 5.996 |

| Dimension B (mm) | | | | |
|---|---|---|---|---|
| | Before barrel polishing treatment | After barrel polishing treatment | After acid etching treatment | After plating treatment |
| 1 | 3.999 | 3.996 | 3.967 | 4.001 |
| 2 | 4.006 | 3.984 | 3.978 | 3.989 |
| 3 | 4.003 | 3.983 | 3.969 | 3.991 |
| 4 | 3.995 | 3.987 | 3.979 | 4.003 |
| 5 | 3.990 | 3.981 | 3.974 | 3.994 |
| 6 | 4.000 | 3.991 | 3.967 | 3.997 |
| 7 | 4.001 | 3.984 | 3.969 | 3.997 |
| 8 | 3.994 | 3.982 | 3.969 | 4.001 |
| 9 | 4.002 | 3.986 | 3.973 | 3.992 |
| 10 | 4.004 | 3.992 | 3.970 | 3.985 |
| Average | 3.999 | 3.987 | 3.972 | 3.995 |

| Dimension C (mm) | | | | |
|---|---|---|---|---|
| | Before barrel polishing treatment | After barrel polishing treatment | After acid etching treatment | After plating treatment |
| 1 | 0.804 | 0.790 | 0.774 | 0.791 |
| 2 | 0.801 | 0.788 | 0.768 | 0.800 |
| 3 | 0.799 | 0.787 | 0.766 | 0.789 |
| 4 | 0.800 | 0.788 | 0.768 | 0.789 |
| 5 | 0.791 | 0.791 | 0.772 | 0.791 |
| 6 | 0.798 | 0.788 | 0.771 | 0.789 |
| 7 | 0.794 | 0.793 | 0.773 | 0.798 |
| 8 | 0.796 | 0.782 | 0.769 | 0.796 |
| 9 | 0.796 | 0.789 | 0.771 | 0.792 |
| 10 | 0.799 | 0.787 | 0.769 | 0.789 |
| Average | 0.798 | 0.788 | 0.770 | 0.792 |

FIGURE 12

| Dimension A (mm) | | | | |
|---|---|---|---|---|
| | Before barrel polishing treatment | After barrel polishing treatment | After acid etching treatment | After plating treatment |
| 1 | 5.998 | 5.984 | 5.974 | 5.992 |
| 2 | 6.002 | 5.992 | 5.980 | 6.003 |
| 3 | 5.993 | 5.977 | 5.977 | 5.994 |
| 4 | 5.999 | 5.990 | 5.978 | 5.981 |
| 5 | 6.003 | 5.989 | 5.983 | 5.992 |
| 6 | 5.998 | 5.979 | 5.978 | 6.002 |
| 7 | 5.994 | 5.989 | 5.969 | 5.996 |
| 8 | 5.997 | 5.984 | 5.981 | 6.004 |
| 9 | 5.991 | 5.992 | 5.969 | 5.982 |
| 10 | 6.002 | 5.986 | 5.982 | 6.001 |
| Average | 5.998 | 5.986 | 5.977 | 5.995 |

| Dimension B (mm) | | | | |
|---|---|---|---|---|
| | Before barrel polishing treatment | After barrel polishing treatment | After acid etching treatment | After plating treatment |
| 1 | 4.004 | 3.994 | 3.977 | 4.005 |
| 2 | 3.998 | 3.988 | 3.984 | 4.002 |
| 3 | 4.003 | 3.979 | 3.975 | 3.989 |
| 4 | 3.994 | 3.990 | 3.984 | 4.002 |
| 5 | 3.999 | 3.984 | 3.969 | 3.992 |
| 6 | 3.992 | 3.988 | 3.974 | 3.990 |
| 7 | 4.004 | 3.981 | 3.976 | 4.000 |
| 8 | 4.002 | 3.989 | 3.969 | 3.988 |
| 9 | 3.992 | 3.986 | 3.972 | 4.002 |
| 10 | 3.997 | 3.994 | 3.980 | 3.994 |
| Average | 3.999 | 3.987 | 3.976 | 3.996 |

| Dimension C (mm) | | | | |
|---|---|---|---|---|
| | Before barrel polishing treatment | After barrel polishing treatment | After acid etching treatment | After plating treatment |
| 1 | 0.802 | 0.784 | 0.769 | 0.792 |
| 2 | 0.799 | 0.788 | 0.776 | 0.796 |
| 3 | 0.801 | 0.790 | 0.768 | 0.791 |
| 4 | 0.802 | 0.783 | 0.772 | 0.798 |
| 5 | 0.790 | 0.788 | 0.766 | 0.794 |
| 6 | 0.795 | 0.781 | 0.765 | 0.799 |
| 7 | 0.797 | 0.795 | 0.774 | 0.794 |
| 8 | 0.799 | 0.789 | 0.775 | 0.792 |
| 9 | 0.802 | 0.782 | 0.769 | 0.789 |
| 10 | 0.796 | 0.787 | 0.772 | 0.788 |
| Average | 0.798 | 0.787 | 0.771 | 0.793 |

FIGURE 13

| Dimension A (mm) | | | | |
|---|---|---|---|---|
| | Before barrel polishing treatment | After barrel polishing treatment | After acid etching treatment | After plating treatment |
| 1 | 5.997 | 5.979 | 5.969 | 6.001 |
| 2 | 6.004 | 5.982 | 5.982 | 5.990 |
| 3 | 5.989 | 5.993 | 5.962 | 6.003 |
| 4 | 5.998 | 5.989 | 5.977 | 5.989 |
| 5 | 5.997 | 5.976 | 5.973 | 5.977 |
| 6 | 6.004 | 5.986 | 5.979 | 6.008 |
| 7 | 5.991 | 5.990 | 5.965 | 6.003 |
| 8 | 5.995 | 5.992 | 5.961 | 5.982 |
| 9 | 6.003 | 5.987 | 5.958 | 5.979 |
| 10 | 6.001 | 5.990 | 5.978 | 6.005 |
| Average | 5.998 | 5.986 | 5.970 | 5.994 |

| Dimension B (mm) | | | | |
|---|---|---|---|---|
| | Before barrel polishing treatment | After barrel polishing treatment | After acid etching treatment | After plating treatment |
| 1 | 3.994 | 3.991 | 3.958 | 3.998 |
| 2 | 4.004 | 3.977 | 3.977 | 4.008 |
| 3 | 3.991 | 3.982 | 3.976 | 3.989 |
| 4 | 4.003 | 3.989 | 3.972 | 4.006 |
| 5 | 3.996 | 3.989 | 3.968 | 3.992 |
| 6 | 4.000 | 3.992 | 3.965 | 4.002 |
| 7 | 3.994 | 3.985 | 3.978 | 3.991 |
| 8 | 3.989 | 3.983 | 3.959 | 3.988 |
| 9 | 4.005 | 3.981 | 3.981 | 4.007 |
| 10 | 3.999 | 3.992 | 3.977 | 3.978 |
| Average | 3.998 | 3.986 | 3.971 | 3.996 |

| Dimension C (mm) | | | | |
|---|---|---|---|---|
| | Before barrel polishing treatment | After barrel polishing treatment | After acid etching treatment | After plating treatment |
| 1 | 0.801 | 0.784 | 0.762 | 0.792 |
| 2 | 0.795 | 0.788 | 0.777 | 0.803 |
| 3 | 0.803 | 0.779 | 0.754 | 0.782 |
| 4 | 0.797 | 0.788 | 0.769 | 0.776 |
| 5 | 0.799 | 0.791 | 0.773 | 0.780 |
| 6 | 0.801 | 0.788 | 0.771 | 0.804 |
| 7 | 0.790 | 0.786 | 0.773 | 0.779 |
| 8 | 0.800 | 0.785 | 0.758 | 0.802 |
| 9 | 0.796 | 0.789 | 0.771 | 0.798 |
| 10 | 0.799 | 0.787 | 0.772 | 0.806 |
| Average | 0.798 | 0.787 | 0.768 | 0.792 |

FIGURE 14

| Dimension A (mm) | | | | |
|---|---|---|---|---|
| | Before barrel polishing treatment | After barrel polishing treatment | After acid etching treatment | After plating treatment |
| 1 | 6.005 | 5.982 | 5.966 | 5.999 |
| 2 | 5.999 | 5.977 | 5.977 | 5.992 |
| 3 | 6.003 | 5.990 | 5.980 | 6.002 |
| 4 | 6.000 | 5.988 | 5.969 | 5.988 |
| 5 | 6.002 | 5.991 | 5.979 | 5.975 |
| 6 | 5.997 | 5.986 | 5.981 | 5.982 |
| 7 | 5.996 | 5.991 | 5.965 | 6.004 |
| 8 | 5.992 | 5.979 | 5.977 | 5.988 |
| 9 | 6.006 | 5.976 | 5.960 | 5.979 |
| 10 | 5.994 | 5.988 | 5.975 | 6.007 |
| Average | 5.999 | 5.985 | 5.973 | 5.992 |

| Dimension B (mm) | | | | |
|---|---|---|---|---|
| | Before barrel polishing treatment | After barrel polishing treatment | After acid etching treatment | After plating treatment |
| 1 | 3.993 | 3.992 | 3.967 | 3.992 |
| 2 | 4.004 | 4.000 | 3.972 | 4.005 |
| 3 | 3.995 | 3.989 | 3.984 | 3.991 |
| 4 | 4.005 | 3.989 | 3.970 | 3.976 |
| 5 | 4.002 | 3.991 | 3.974 | 4.003 |
| 6 | 3.996 | 3.989 | 3.959 | 3.989 |
| 7 | 3.991 | 3.990 | 3.972 | 3.994 |
| 8 | 3.989 | 3.986 | 3.961 | 3.986 |
| 9 | 4.006 | 3.980 | 3.977 | 4.002 |
| 10 | 4.001 | 3.994 | 3.963 | 3.981 |
| Average | 3.998 | 3.990 | 3.970 | 3.992 |

| Dimension C (mm) | | | | |
|---|---|---|---|---|
| | Before barrel polishing treatment | After barrel polishing treatment | After acid etching treatment | After plating treatment |
| 1 | 0.800 | 0.788 | 0.772 | 0.782 |
| 2 | 0.793 | 0.790 | 0.773 | 0.799 |
| 3 | 0.804 | 0.774 | 0.760 | 0.802 |
| 4 | 0.799 | 0.787 | 0.759 | 0.789 |
| 5 | 0.802 | 0.779 | 0.783 | 0.772 |
| 6 | 0.794 | 0.791 | 0.778 | 0.800 |
| 7 | 0.792 | 0.788 | 0.772 | 0.781 |
| 8 | 0.803 | 0.782 | 0.764 | 0.792 |
| 9 | 0.797 | 0.784 | 0.770 | 0.799 |
| 10 | 0.794 | 0.792 | 0.766 | 0.801 |
| Average | 0.798 | 0.786 | 0.770 | 0.792 |

FIGURE 15

| Dimension A (mm) | | | | |
|---|---|---|---|---|
| | Before barrel polishing treatment | After barrel polishing treatment | After acid etching treatment | After plating treatment |
| 1 | 6.003 | 5.979 | 5.972 | 6.005 |
| 2 | 6.002 | 5.985 | 5.969 | 5.994 |
| 3 | 5.992 | 5.988 | 5.980 | 6.003 |
| 4 | 5.998 | 5.994 | 5.977 | 5.989 |
| 5 | 6.001 | 5.988 | 5.974 | 5.979 |
| 6 | 5.994 | 5.984 | 5.982 | 5.981 |
| 7 | 5.999 | 5.984 | 5.967 | 6.001 |
| 8 | 5.992 | 5.977 | 5.981 | 5.986 |
| 9 | 6.004 | 5.981 | 5.963 | 5.977 |
| 10 | 5.992 | 5.990 | 5.974 | 6.008 |
| Average | 5.998 | 5.985 | 5.974 | 5.992 |

| Dimension B (mm) | | | | |
|---|---|---|---|---|
| | Before barrel polishing treatment | After barrel polishing treatment | After acid etching treatment | After plating treatment |
| 1 | 3.995 | 3.982 | 3.985 | 4.003 |
| 2 | 4.001 | 3.998 | 3.977 | 4.002 |
| 3 | 4.002 | 3.999 | 3.985 | 3.996 |
| 4 | 3.999 | 4.003 | 3.968 | 3.992 |
| 5 | 3.991 | 3.988 | 3.979 | 3.980 |
| 6 | 3.995 | 3.994 | 3.982 | 4.003 |
| 7 | 4.001 | 3.989 | 3.960 | 3.978 |
| 8 | 3.990 | 4.001 | 3.980 | 4.005 |
| 9 | 4.004 | 3.984 | 3.969 | 3.988 |
| 10 | 3.998 | 3.992 | 3.972 | 3.995 |
| Average | 3.998 | 3.993 | 3.976 | 3.994 |

| Dimension C (mm) | | | | |
|---|---|---|---|---|
| | Before barrel polishing treatment | After barrel polishing treatment | After acid etching treatment | After plating treatment |
| 1 | 0.802 | 0.789 | 0.769 | 0.800 |
| 2 | 0.804 | 0.772 | 0.784 | 0.798 |
| 3 | 0.788 | 0.793 | 0.767 | 0.804 |
| 4 | 0.794 | 0.792 | 0.780 | 0.791 |
| 5 | 0.798 | 0.775 | 0.763 | 0.767 |
| 6 | 0.795 | 0.792 | 0.783 | 0.794 |
| 7 | 0.792 | 0.789 | 0.759 | 0.796 |
| 8 | 0.799 | 0.777 | 0.782 | 0.798 |
| 9 | 0.801 | 0.794 | 0.781 | 0.802 |
| 10 | 0.793 | 0.784 | 0.777 | 0.804 |
| Average | 0.797 | 0.786 | 0.775 | 0.795 |

FIGURE 16

| | Nd (wt%) | Pr (wt%) | Dy (wt%) | Tb (wt%) | B (wt%) | Al (wt%) | Co (wt%) | Cu (wt%) | Zr (wt%) | Nb (wt%) | Fe |
|---|---|---|---|---|---|---|---|---|---|---|---|
| Composition A | 24.5 | 5.5 | — | — | 1.0 | 0.2 | 0.5 | 0.05 | — | — | bal. |
| Composition B | 25.0 | 5.5 | — | — | 1.0 | 0.2 | 0.5 | 0.05 | 0.15 | — | bal. |
| Composition C | 20.0 | 5.5 | 5.0 | — | 1.0 | 0.25 | 0.5 | 0.10 | — | — | bal. |
| Composition D | 22.0 | — | 7.5 | — | 1.0 | 0.25 | 0.5 | 0.07 | — | 0.7 | bal. |
| Composition E | 24.5 | 5.5 | - | — | 1.0 | 0.2 | 0.5 | 0.05 | 0.05 | — | bal. |
| Composition F | 24.5 | 5.5 | - | — | 1.0 | 0.2 | 0.5 | 0.05 | 0.30 | — | bal. |
| Composition G | 20.0 | 5.5 | 5.0 | — | 1.0 | 0.2 | 0.5 | 0.05 | — | 0.2 | bal. |
| Composition H | 20.0 | 5.5 | 5.0 | — | 1.0 | 0.2 | 0.5 | 0.05 | — | 1.5 | bal. |
| Composition I | 20.0 | 5.5 | 5.0 | — | 1.0 | 0.2 | 0.5 | 0.05 | — | 2.3 | bal. |
| Composition J | 28.5 | — | 1.0 | 1.0 | 1.0 | 0.25 | 0.5 | 0.10 | 0.20 | — | bal. |
| Composition K | 30.5 | — | — | — | 1.0 | 0.2 | 0.5 | 0.10 | 0.20 | — | bal. |

FIGURE 17

| Sample No. | Alloy composition | Plating | Hydrogen concentration profile | Thickness of hydrogen-rich layer (1000 ppm or more in hydrogen) [μm] | Hydrogen concentration at a position of 500 μm from surface [ppm] | Peeling off strength [N/m] | | | Corrosion resistance | Magnetic properties | | |
|---|---|---|---|---|---|---|---|---|---|---|---|---|
| | | | | | | Before thermal shock test | After thermal shock test | Rate of change [%] | | Br [T] | HcJ [kA/m] | Hk/Hcj [%] |
| 29 | Composition A | Electrolytic Ni | Uniform | 0 | 25 | 83 | 80 | -3.6 | 5/100 | 1.473 | 907 | 96.0 |
| 30 | | | Decreasing continuously | 20 | 20 | 125 | 122 | -2.4 | 0/100 | | | |
| 31 | | | | 40 | 10 | 124 | 126 | 1.6 | 0/100 | | | |
| 32 | | | | 100 | 15 | 130 | 128 | -1.5 | 1/100 | | | |
| 33 | | | | 160 | 20 | 126 | 127 | 0.8 | 2/100 | | | |
| 34 | | | | 200 | 25 | 120 | 117 | -2.5 | 2/100 | | | |
| 35 | | | | 250 | 45 | 108 | 102 | -5.6 | 3/100 | | | |
| 36 | | | | 330 | 70 | 98 | 79 | -19.4 | 5/100 | | | |
| 37 | Composition B | | Decreasing continuously | 45 | 45 | 135 | 129 | -4.4 | 0/100 | 1.460 | 945 | 97.5 |
| 38 | Composition C | | | 20 | 20 | 130 | 130 | 0 | 0/100 | 1.431 | 2020 | 96.2 |
| 39 | Composition D | | | 22 | 22 | 132 | 130 | -1.5 | 0/100 | 1.220 | 2325 | 98.3 |
| 40 | Composition E | | | 40 | 40 | 122 | 123 | 0.8 | 0/100 | 1.475 | 879 | 94.9 |
| 41 | Composition F | | | 20 | 20 | 125 | 122 | -2.4 | 0/100 | 1.461 | 922 | 92.8 |
| 42 | Composition G | | | 20 | 20 | 134 | 130 | -3.0 | 0/100 | 1.324 | 2040 | 96.7 |
| 43 | Composition H | | | 20 | 20 | 124 | 122 | -1.6 | 0/100 | 1.297 | 2115 | 97.3 |
| 44 | Composition I | | | 20 | 20 | 133 | 130 | -2.3 | 0/100 | 1.259 | 2190 | 97.3 |
| 45 | Composition J | | | 50 | 20 | 133 | 129 | -3.0 | 0/100 | 1.424 | 1405 | 98.1 |
| 46 | Composition K | | | 50 | 25 | 127 | 128 | 0.8 | 0/100 | 1.451 | 925 | 97.6 |
| 47 | Composition A | Cu+Ni | | 40 | 15 | 200 | 194 | -3.0 | 0/100 | - | - | - |
| 48 | Composition A | Cu+Ni+Sn | | 40 | 15 | 212 | 208 | -1.9 | 0/100 | - | - | - |

FIGURE 18

| | Nd (wt%) | Pr (wt%) | B (wt%) | Al (wt%) | Co (wt%) | Cu (wt%) | Fe |
|---|---|---|---|---|---|---|---|
| Sintered body composition | 24.5 | 5.5 | 1.0 | 0.2 | 0.5 | 0.05 | bal. |

FIGURE 19

| Sample No. | Plating conditions | Number of layers | Thickness of hydrogen-rich layer (μm) | | | |
|---|---|---|---|---|---|---|
| | | | 1st Layer | 2nd Layer | 3rd Layer | 4th Layer |
| 49 | 1 | 2 | 30 | 20 | — | — |
| 50 | 2 | 3 | 50 | 30 | 20 | — |
| 51 | 3 | 4 | 40 | 60 | 30 | 20 |
| 52 | 4 | 1 | 50 | — | — | — |
| 53 | 5 | 1 | 250 | — | — | — |
| 54 | 6 | 1 | 350 | — | — | — |
| 55 | 7 | 0 | — | — | — | — |

FIGURE 20

| Sample No. | Peeling off strength [N/m] | | | Corrosion resistance | Magnetic properties | | |
|---|---|---|---|---|---|---|---|
| | Before thermal shock test | After thermal shock test | Rate of change [%] | | Br [T] | HcJ [kA/m] | Hk/Hcj [%] |
| 49 | 115 | 110 | -4.3 | 0/100 | 1.473 | 907 | 96 |
| 50 | 113 | 107 | -5.3 | 0/100 | | | |
| 51 | 121 | 118 | -2.5 | 0/100 | | | |
| 52 | 120 | 119 | -0.8 | 0/100 | | | |
| 53 | 103 | 104 | 1.0 | 3/100 | | | |
| 54 | 97 | 93 | -4.1 | 0/100 | | | |
| 55 | 83 | 80 | -3.6 | 7/100 | | | |

R-T-B SYSTEM PERMANENT MAGNET

TECHNICAL FIELD

The present invention relates to the improvement of the corrosion resistance of an R-T-B system permanent magnet.

BACKGROUND ART

R-T-B system permanent magnets (wherein R represents one or more rare earth elements and T represents Fe or Fe and Co) in each of which the main phase thereof comprises grains composed of an $R_2T_{14}B$ type intermetallic compound (wherein referred to as $R_2T_{14}B$ grains in the present invention) have been used in various electric devices and machines because the R-T-B system permanent magnets are each excellent in magnetic properties and a main component of each thereof, Nd, is abundant as a natural resource and relatively inexpensive.

Even the R-T-B system permanent magnets having excellent magnetic properties involve some technical problems to be solved. One of such problems is corrosion resistance. More specifically, the R-T-B system permanent magnets are poor in corrosion resistance because their main constituent elements, namely, R and Fe, are elements susceptible to oxidation. Accordingly, an overcoat to prevent corrosion is formed on the magnet surface. For the overcoat, resin coating, chromate film, plating or the like is adopted; among these, particularly, a method of plating a metal coat typified by Ni plating is frequently used because of being excellent in corrosion resistance, abrasion resistance and the like.

The grain boundary phase (also referred to as R-rich phase), one of the phases constituting each of the R-T-B system permanent magnets, is an origin of the corrosion. Consequently, as a measure for improving the corrosion resistance of the R-T-B system permanent magnets, it is a possible approach that in each of the magnets, the content of the R-rich phase is decreased by reducing the amount of R and the crystal structure of the magnet is made finer.

However, reduction of the content of R degrades the magnetic properties. An R-T-B system permanent magnet is generally produced by means of a powder metallurgy method in which a fine alloy powder of a few microns in particle size is compacted and sintered; such an alloy powder contains a considerable amount of chemically extremely active R, and hence the powder undergoes oxidation during the production steps to result in reduction of the amount of R effective in attaining magnetic properties; and thus, it becomes impossible to overlook the degradation of the magnetic properties, in particular, the degradation of the coercive force. Accordingly, among the R-T-B system permanent magnets there are many examples which are set to contain a relatively large amount of R such as 31 wt % or more.

For the above described problems, Patent Document 1 (Japanese Patent No. 3171426) proposes a sintered permanent magnet which is improved in corrosion resistance by having a composition in terms of percentages by weight such that R (R represents one or more rare earth elements): 27.0 to 31.0%, B: 0.5 to 2.0%, N: 0.02 to 0.15%, O: 0.25% or less, C: 0.15% or less, and the balance being Fe; and the coercive force (iHc) thereof is 13.0 kOe or more. Patent Document 2 (Japanese Patent No. 2966342) also proposes a sintered permanent magnet which has a composition in terms of percentages by weight such that R (R represents one or more rare earth elements): 27.0 to 31.0%, B: 0.5 to 2.0%, N: 0.02 to 0.15%, O: 0.25% or less, C: 0.15% or less, and the balance being Fe; and the sum of the areas of the $R_2Fe_{14}B$ grains of 10 μm or less in grain size is 80% or more and the sum of the areas of the $R_2Fe_{14}B$ grains of 13 μm or more in grain size is 10% or less, in relation to the total area of the main phase.

The proposal of Patent Document 1 is based on the finding that in the R—Fe—B based sintered permanent magnet which has a rare earth content falling within a specified range, and an oxygen content and a carbon content each being equal to a specified value or less, the corrosion resistance thereof is improved and practical, high magnetic properties can also be obtained by setting the nitrogen content thereof to fall within a specified range. The proposal of Patent Document 2 is also based on the finding that the corrosion resistance of the sintered permanent magnet is further improved by further setting the $R_2Fe_{14}B$ grain size to be a certain specified value or less.

As described above, the R-T-B system permanent magnets each has an overcoat formed on the surface thereof by electrolytic plating or the like. Accordingly, the corrosion resistance of an R-T-B system permanent magnet should be investigated under the conditions that the overcoat is formed.

Patent Document 3 (Japanese Patent Laid-Open No. 5-226125), Patent Document 4 (Japanese Patent Laid-Open No. 2001-135511) and Patent Document 5 (Japanese Patent Laid-Open No. 2001-210504) present interesting disclosures for the plating of R-T-B system permanent magnets.

When the Ni plating or Ni alloy plating method is applied to the R-T-B system permanent magnet which has a high hydrogen absorptivity and has a property that hydrogen absorptivity thereof embrittles itself, the hydrogen generated during plating is absorbed inside the R-T-B system permanent magnet, so that brittle fracture and plating exfoliation are caused on the plating interface and the corrosion resistance can no longer be maintained. In this connection, Patent Document 3 proposes that by heating an R-T-B system permanent magnet plated with Ni or a Ni alloy under vacuum at temperatures of 600° C. or higher and lower than 800° C., the hydrogen absorbed during plating in the magnet or in the plating layer is expelled, and thus, for example, the diffusion of the hydrogen in the plating layer into the magnet is prevented on the way of a longtime operation to prevent the hydrogen embrittlement of the magnet interface.

Patent Document 4 points out that the squareness of the demagnetization curve is remarkably degraded when, for example, the magnetic properties are evaluated after magnetizing a magnet with a Ni coat formed by electrolytic plating, and the cause of the degradation is the increase of the hydrogen amount contained in the magnet body and the coat after undergoing coating. Accordingly, Patent Document 4 proposes that electroless plating or vapor phase plating is adopted as the means for forming the overcoat, and the hydrogen amount contained in the magnet body and the coat is controlled to be 100 ppm or less.

Patent Document 5 also proposes that the amount of hydrogen contained in the plating coat of the R-T-B system permanent magnet is to be reduced to 100 ppm or less on the basis of the finding that the thermal demagnetization of the R-T-B system permanent magnet is largely varied depending on the amount of the hydrogen contained in the plating coat.

According to Patent Document 3, the heating under vacuum at temperatures of 600° C. or higher and lower than 800° C. reduces the amount of hydrogen, but tends to degrade the magnetic properties and brings about a fear of degrading the plating coat. The degradation of the plating coat causes the degradation of the corrosion resistance, and hence will be incompatible with the primary purpose of the plating coat. Patent Document 4 does not involve as a subject the electrolytic plating leading to the most effective overcoat in the R-T-B system permanent magnet. According to Patent Document 5, it is necessary electrolytic plating be applied with a low current density and a low voltage; this may bring about a fear of considerable degradation of the production efficiency and no account is taken for the corrosion resistance of the overcoat formed by electrolytic plating.

More sever dimensional precision (for example, to a tolerance of 5/100 mm) than hitherto is recently required for R-T-B system permanent magnets as the case may be. It is the dimensions of a magnet with an overcoat that are required to be severely precise. However, needless to say, the dimensions concerned are significantly affected by the dimensions of the magnet body. To this issue, various approaches have been attempted from the dimensional precision of the magnet body and that of the overcoat. As for the magnet body, it is subjected to barrel polishing treatment before plating so as to round the edge portions thereof which otherwise tend to undergo formation of humps of the plating coat; however, there is a problem such that the surface of the magnet body is partially collapsed (detachment of grains) when thereafter undergoing acid etching and plating coat formation, giving a factor to degrade the dimensional precision of the surface, in particular, the edge portions.

With regard to some of the problems described above, as will be described later, the present inventors have found that it is effective to control the amount or the state of the hydrogen contained in the surface layer portion of the R-T-B system permanent magnet. Accordingly, an object of the present invention is to propose a preferable amount and a preferable state of the contained hydrogen for the R-T-B system permanent magnet, in particular, the R-T-B system permanent magnet with an overcoat formed thereon. This proposal may be sorted out into a plurality of embodiments. According to an embodiment, it is an object to improve the corrosion resistance of the R-T-B system permanent magnet with an overcoat formed thereon without degrading the magnetic properties. In another embodiment, it is an object to provide an R-T-B system permanent magnet compatible with the overcoat formation based on electrolytic plating and capable of fully ensuring the corrosion resistance as a primary target of the overcoat formation without substantially degrading the production efficiency. In yet another embodiment, it is an object to provide an R-T-B system permanent magnet having a high dimensional precision by suppressing the partial collapse (detachment of grains) of the surface thereof.

DISCLOSURE OF THE INVENTION

As described above, the present invention is characterized by controlling the amount of hydrogen in the surface layer portion of an R-T-B system permanent magnet. In an embodiment of the present invention, a predetermined amount of hydrogen is made to present in a predetermined thickness in the surface layer portion (embodiment 1), and in another embodiment, the relative amount of hydrogen is varied inside the R-T-B system permanent magnet (embodiment 2).

In embodiment 1, in sum, there is provided an R-T-B system permanent magnet comprising a magnet body comprising a sintered body comprising at least a main phase comprising $R_2T_{14}B$ grains (wherein R represents one or more rare earth elements, and T represents one or more transition metal elements including Fe or Fe and Co essentially) and a grain boundary phase containing R in a larger amount than the main phase, the magnet body having a 300 μm or less thick (not inclusive of zero thick) hydrogen-rich layer having a hydrogen concentration of 300 ppm or more formed in the surface layer portion; and an overcoat covering the surface of the magnet body.

Embodiment 1 may comprise an embodiment (embodiment 1-1) in which the hydrogen-rich layer has a hydrogen concentration of 1000 ppm or more, and another embodiment (embodiment 1-2) in which the hydrogen-rich layer has a hydrogen concentration of 300 to 1000 ppm. According to embodiment 1-1, the corrosion resistance of the R-T-B system permanent magnet with an overcoat formed thereon can be improved without degrading the magnetic properties thereof. Also, according to embodiment 1-2, partial collapse of the surface of the magnet body, occurring when an overcoat is formed, can be suppressed.

In embodiment 1, the hydrogen-rich layer has a thickness of preferably 200 μm or less, and more preferably 100 μm or less.

Also, in embodiment 1, it is preferable that in the sintered body constituting the magnet body, the sum of the areas of the $R_2Fe_{14}B$ grains of 10 μm or less in grain size is 90% or more, and the sum of the areas of the $R_2Fe_{14}B$ grains of 20 μm or more in grain size is 3% or less, in relation to the total area of the main phase.

In embodiment 1, the magnet body preferably has a composition comprising R: 27.0 to 35.0 wt % (wherein R represents one or more rare earth elements), B: 0.5 to 2.0 wt %, O: 2500 ppm or less, C: 1500 ppm or less, N: 200 to 1500 ppm, and the balance substantially being Fe; and the magnet body preferably further comprises one or more of Nb: 0.1 to 2.0 wt %, Zr: 0.05 to 0.25 wt %, Al: 0.02 to 2.0 wt %, Co: 0.3 to 5.0 wt % and Cu: 0.01 to 1.0 wt %.

Additionally, in embodiment 1, the overcoat is preferably formed by electrolytic metal plating.

Next, embodiment 2 of the present invention is characterized in that there is provided a magnet body comprising a sintered body including at least a main phase comprising the $R_2T_{14}B$ grains and a grain boundary phase containing R in a larger amount than the main phase and a overcoat covering the surface of the magnet body, the magnet body having a hydrogen-rich layer, higher in the hydrogen concentration than the central portion thereof, on the surface layer portion thereof. In this embodiment 2, the hydrogen-rich layer has a hydrogen concentration decreased from the surface of the magnetic body toward the inside of the magnet body. The decrease of the hydrogen concentration comprises the following two cases: one is a case (embodiment 2-1) where the hydrogen concentration is continuously decreased from the surface of the magnet body toward the inside of the magnet body, and the other is a case (embodiment 2-2) where the hydrogen concentration is stepwise decreased from the surface of the magnet body toward the inside of the magnet body. Both in embodiment (2-1) and in embodiment (2-2), the hydrogen-rich layer preferably has a region with a hydrogen concentration of 1000 ppm or more. The region having a hydrogen concentration of 1000 ppm or more preferably has a thickness of 300 μm or less.

Also in embodiment 2, the magnet body preferably has a composition comprising R: 27.0 to 35.0 wt % (wherein R represents one or more rare earth elements), B: 0.5 to 2.0 wt %, O: 2500 ppm or less, C: 1500 ppm or less, N: 200 to 1500 ppm, and the balance substantially being Fe; and the magnet body preferably further comprises one or more of Nb: 0.1 to 2.0 wt %, Zr: 0.05 to 0.25 wt %, Al: 0.02 to 2.0 wt %, Co: 0.3 to 5.0 wt % and Cu: 0.01 to 1.0 wt %. Additionally, the overcoat is preferably formed by electrolytic metal plating.

BRIEF DESCRIPTION OF THE DRAWINGS

FIG. 4 is a table showing the compositions of R-T-B system permanent magnets in Example 1-1-1;

FIG. 5 is a table showing the corrosion resistance, the magnetic properties and the grain size distribution of the $R_2Fe_{14}B$ grains in each of the R-T-B system permanent magnets in Example 1-1-1;

FIG. 6 is a table showing the compositions of R-T-B system permanent magnets in Example 1-1-2;

FIG. 7 is a table showing the corrosion resistance, the magnetic properties and the grain size distribution of the $R_2Fe_{14}B$ grains in each of the R-T-B system permanent magnets in Example 1-1-2;

FIG. 8 is a table showing the composition and the magnetic properties of an R-T-B system permanent magnet in Example 1-2;

FIG. 9 is a table showing the electrolytic plating conditions in Example 1-2;

FIG. 10 is a table showing the standard deviations of the dimensional variations in Example 1-2;

FIGS. 11 to 15 are tables showing the results of the dimensions of sintered bodies in Example 1-2, measured before barrel polishing treatment, after barrel polishing treatment, after etching treatment and after electrolytic plating;

FIG. 16 is a table showing the compositions of R-T-B system permanent magnets in Example 2-1;

FIG. 17 is a table showing the evaluation results of the properties of the R-T-B system permanent magnets in Example 2-1;

FIG. 18 is a table showing the composition for R-T-B system permanent magnets in Example 2-2;

FIG. 19 is a table showing the states of the hydrogen-rich layers of the R-T-B system permanent magnets in Example 2-2; and FIG. 20 is a table showing the measurement results of the corrosion resistance and the magnetic properties of the R-T-B system permanent magnets in Example 2-2.

BEST MODE FOR CARRYING OUT THE INVENTION

In the following, embodiments of the present invention will be described.

<Hydrogen-rich Layer>

First, the hydrogen-rich layer characterizing the present invention will be described.

Figure 1:
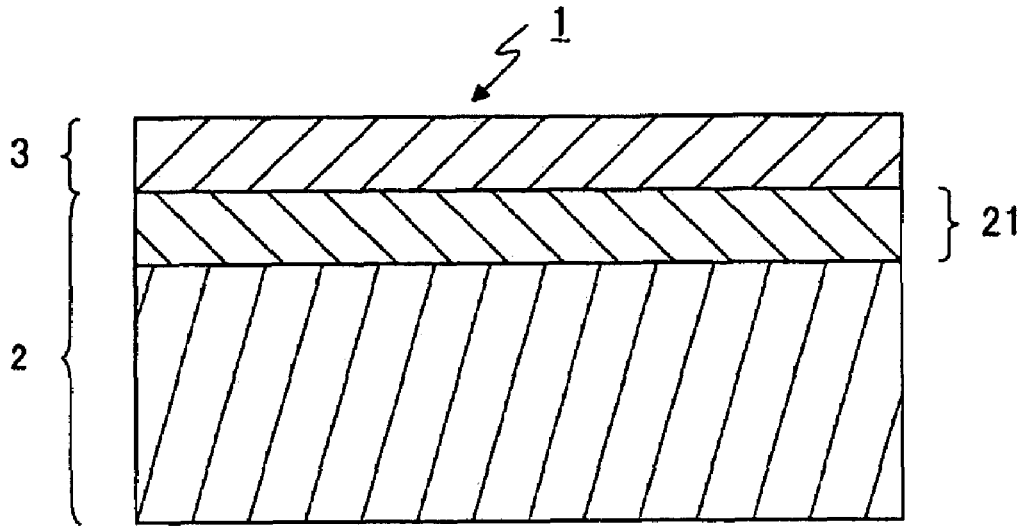
FIG. 1 is a schematic diagram illustrating a hydrogen-rich layer in the present invention.

As shown in FIG. 1, an R-T-B system permanent magnet 1 of the present invention comprises a magnet body 2 and an overcoat 3 covering the surface of the magnet body 2. In the surface layer portion of the magnet body 2 resides a hydrogen-rich layer 21 which is higher in hydrogen concentration than the inside of the magnet body 2. Here, the term "hydrogen-rich" means that the hydrogen concentration in the surface layer portion of the magnet body 2 is higher than that of the inside of the magnet body 2.

The hydrogen-rich layer 21 according to embodiment 1 contains hydrogen in an amount of 300 ppm or more, and in particular, the hydrogen-rich layer 21 according to embodiment 1-1 contains hydrogen in an amount of 1000 ppm or more. The presence of the hydrogen-rich layer 21 improves the corrosion resistance; however, when the thickness of this layer is 300 μm or more, the corrosion resistance becomes the same as the corrosion resistance to be obtained in the absence of the hydrogen-rich layer 21. Accordingly, in embodiment 1-1, the thickness of the hydrogen-rich layer 21 is set to be less than 300 μm (not inclusive of 0). The thickness of the hydrogen-rich layer 21 according to embodiment 1-1 is preferably 10 to 200 μm and more preferably 10 to 50 μm.

The improvement effect of the corrosion resistance attained by providing the hydrogen-rich layer 21 is definitely displayed when a corrosion resistant coat is formed on the surface of the R-T-B system permanent magnet 1. More specifically, when the R-T-B system permanent magnet 1 has an overcoat 3 formed on the surface thereof by Ni plating or the like, the overcoat 3 covers the R-T-B system permanent magnet 1 through the intermediary of the hydrogen-rich layer 21. The hydrogen-rich layer 21 has asperities formed on the surface thereof, and it is understood that the adhesiveness between the magnet body 2 and the overcoat 3 is thereby improved to improve the corrosion resistance. In environments of high temperatures and high humidities, however, it is possible that swelling of the overcoat 3 may be caused by the generation of hydrogen gas from the hydrogen-rich layer 21. This may be understood to be a cause to degrade the corrosion resistance when the thickness of the hydrogen-rich layer 21 is thick.

Next, the hydrogen-rich layer 21 in embodiment 1-2 contains hydrogen in an amount of 300 to 1000 ppm. Either when the hydrogen concentration is less than 300 ppm, or when it exceeds 1000 ppm, the dimensional precision of the magnet body 2 is degraded, and accordingly the dimensional precision of the R-T-B system permanent magnet 1 covered with the overcoat 3 is degraded. Also when the thickness of the hydrogen-rich layer 21 exceeds 300 μm, the dimensional precision becomes the same. Accordingly, in embodiment 1-2, the thickness of the hydrogen-rich layer 21 is set to be 300 μm or less (not inclusive of 0). In embodiment 1-2, the thickness of the hydrogen-rich layer 21 is preferably 10 to 200 μm, and more preferably 10 to 100 μm.

The hydrogen concentration and the thickness of the hydrogen-rich layer 21 can be varied by controlling the plating conditions when the overcoat 3 is formed by electrolytic plating. For example, the thickness of the hydrogen-rich layer 21 can be made thinner by setting the current density at a lower level when plating, and on the contrary, the thickness of the hydrogen-rich layer 21 can be made thicker by setting the current density at a higher level. In this way, the hydrogen-rich layer 21 can be formed by electrolytic plating, and it can also be formed by acid etching sometimes carried out as a pretreatment for forming the overcoat 3. Thus, the present invention comprises a formation of the overcoat by a processing other than electrolytic plating after acid etching. This is also the case for embodiment 2.

Now, embodiment 2 will be described.

Figure 2:
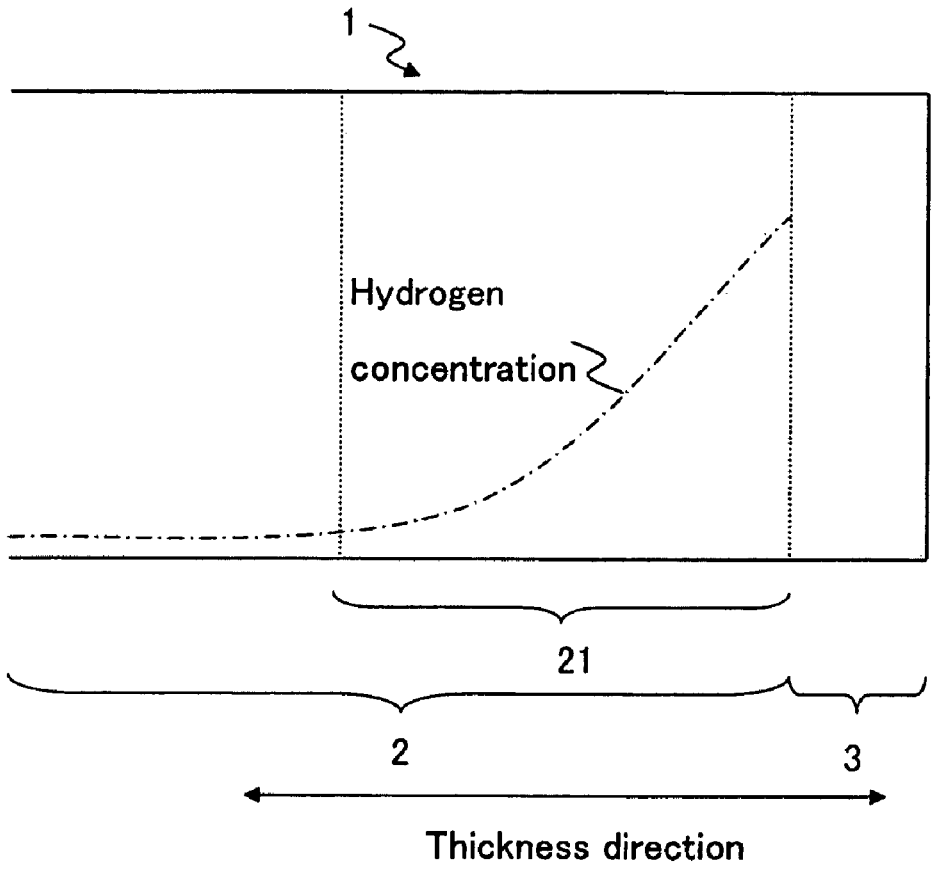
FIG. 2 is a schematic diagram illustrating the hydrogen-rich layer in embodiment 2-1.

A section of the R-T-B system permanent magnet 1 according to embodiment 2-1 is schematically shown in FIG. 2, where the same reference numerals as in FIG. 1 respectively refer the portions denoted by the same numerals. As shown in FIG. 2, the hydrogen-rich layer 21, characterizing the present invention, resides in the surface layer portion of the magnet body 2. As shown in FIG. 2, in the hydrogen-rich layer 21, the hydrogen concentration is continuously decreased from the surface of the magnet body 2 toward the inside of the magnet body 2. Additionally, it is preferable that the hydrogen-rich layer 21 contains hydrogen in a concentration of 1000 ppm or more in a predetermined region ranging from the side in contact with overcoat 3 to a certain depth inside the layer concerned, and the region containing hydrogen in a concentration of 1000 ppm or more ranges from the side in contact with the overcoat 3 to a depth of 300 μm inside the layer concerned. The presence of the hydrogen-rich layer 21 in such conditions as described above improves the corrosion resistance.

For the purpose of making the hydrogen-rich layer 21 take a state in which the hydrogen concentration therein is decreased continuously, the current density and other conditions may be controlled when the overcoat 3 is formed by electrolytic plating, as will be clearly seen in a specific manner with reference to Examples to be described later. The hydrogen-rich layer 21 according to embodiment 2-1 can be formed as described above by electrolytic plating, and it can also be formed by acid etching sometimes carried out as a pretreatment for forming the overcoat 3. Thus, as described above, embodiment 2-1 comprises an embodiment in which the overcoat 3 is formed by a processing other than electrolytic plating after acid etching.

Now, embodiment 2-2 will be described.

Figure 3:
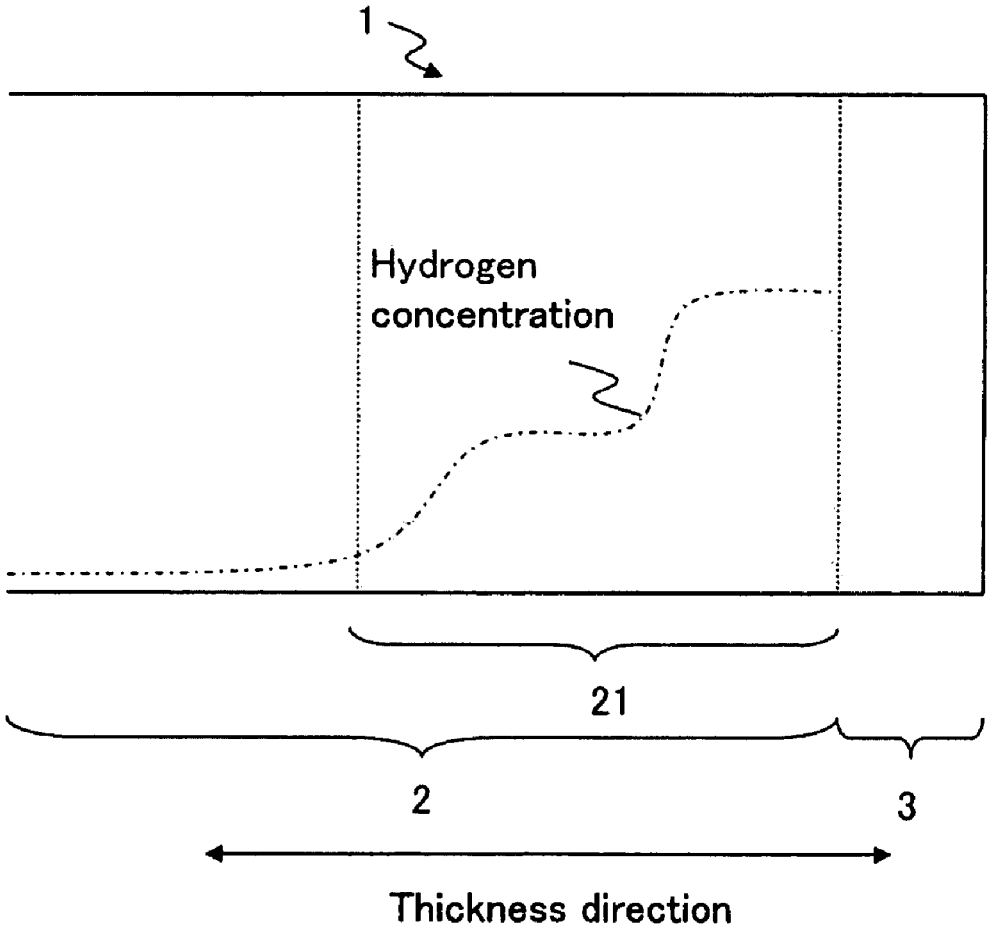
FIG. 3 is a schematic diagram illustrating the hydrogen-rich layer in embodiment 2-2.

In embodiment 2-2, as shown in FIG. 3, the hydrogen concentration in the hydrogen-rich layer 21 is decreased stepwise from the surface of the magnet body 2 toward the inside of the magnet body 2. Additionally, it is preferable that the hydrogen-rich layer 21 contains hydrogen in a concentration of 1000 ppm or more in a predetermined region ranging from the side in contact with overcoat 3 to a certain depth inside the layer concerned, and the region containing hydrogen in a concentration of 1000 ppm or more ranges from the side in contact with the overcoat 3 to a depth of 300 μm inside the layer concerned. The presence of the hydrogen-rich layer 21 in such conditions as described above improves the corrosion resistance. It is to be noted that a particular example shown in FIG. 3 is an example of two-step decrease of the hydrogen concentration in the hydrogen-rich layer 21, but the present invention may include either one-step cases or three or more-step cases. In the present invention, a judgment as to whether the hydrogen concentration is stepwise varied or not is made on the basis of a criterion whether the variation rate (in absolute value) of the hydrogen. concentration along the thickness direction of the magnet body 2 is 300 ppm/100 μm or less or not in a particular region and the length of the region is 20 μm or more or not.

For the purpose of making the hydrogen-rich layer 21 take a state in which the hydrogen concentration therein is decreased stepwise, the current density and other conditions may be controlled when the overcoat 3 is formed by electrolytic plating, as will be clearly seen in a specific manner with reference to Examples to be described later. The hydrogen-rich layer 21 according to embodiment 2-2 can be formed as described above by electrolytic plating, and it can also be formed by acid etching sometimes carried out as a pretreatment for forming the overcoat 3. Thus, as described above, embodiment 2-2 comprises an embodiment in which the overcoat 3 is formed by a processing other than electrolytic plating after acid etching.

<Overcoat>

In the present invention, an overcoat 3 is formed by electrolytic plating on the surface of the magnet. As materials for the overcoat 3, there maybe used anyone selected from the group consisting of Ni, Ni—P, Cu, Zn, Cr, Sn and Al; and there may also be used other materials. Two or more of these materials may also be used for covering in a multi-layered manner.

The overcoat 3 formed by electrolytic plating is a typical embodiment of the present invention, but formation of the overcoat 3 by means of other processes is not prohibited with the proviso that the hydrogen-rich layer 21 be present. Among the examples of the overcoat 3 formed by other processes, the coats formed by electroless plating and chemical treatments including chromate treatment, and resin coats, and combinations thereof are practical.

The thickness of the overcoat 3 needs to be varied according to the size of the magnet body 2, desired levels of the corrosion resistance and the like, and may be appropriately set within a range from 1 to 100 μm. The thickness of the overcoat 3 is preferably 1 to 50 μm.

<Structure>

As is well known, the R-T-B system permanent magnet of the present invention is constituted with a sintered body comprising at least a main phase consisting of the $R_2Fe_{14}B$ grains and a grain boundary phase containing R in a larger amount than the main phase.

In the R-T-B system permanent magnet of the present invention, the sum of the areas of the $R_2Fe_{14}B$ grains of 10 μm or less in grain size is set to be 90% or more, and the sum of the areas of the $R_2Fe_{14}B$ grains of 20 μm or more in grain size is set to be 3% or less, in relation to the total area of the main phase. The corrosion resistance of the R-T-B system permanent magnet exhibits a dependence on the grains, in such a way that excellent corrosion resistance can be ensured by controlling the grain size to fall within the above described ranges. The condition that coarse grains are not contained is preferable for the purpose of ensuring the magnetic properties, in particular, the coercive force (HcJ) and the squareness (Hk/Hcj). The squareness (Hk/Hcj) makes an index representing the performance of the magnet, and exhibits a degree of squareness in the magnetic hysteresis loop in the second quadrant. Here, Hk represents an external magnetic field strength at which the magnetic flux density amounts to 90% of the residual magnetic flux density in the magnetic hysteresis loop in the second quadrant.

Various methods may be adopted for the purpose of constraining the grain size of the $R_2Fe_{14}B$ grains constituting the main phase to meet the above specified ranges; in this connection, it is important to use fine powders each having a predetermined mean particle size and a predetermined particle size distribution. It is also effective to carry out sintering at relatively low temperatures and over a long period of time.

<Chemical Composition>

The R-T-B system permanent magnet of the present invention preferably contains one or more rare earth elements (wherein R) in an amount of 27.0 to 35.0 wt %.

In the present invention, the rare earth elements (wherein R) have a concept including Y, and accordingly, in the present invention, one or more elements can be selected from the group consisting of La, Ce, Pr, Nd, Sm, Eu, Gd, Tb, Dy, Ho, Er, Yb and Lu. When the amount of the one or more selected rare earth elements is less than 27.0 wt %, α-Fe having soft magnetism and the like segregate to remarkably degrade the coercive force, and the sinterability is also degraded. On the other hand, when the amount of the one or more selected rare earth elements exceeds 35.0 wt %, the content of the R-rich phase is increased to degrade the corrosion resistance, and the volume ratio of the $R_2T_{14}B$ grains constituting the main phase is decreased and the residual magnetic flux density is decreased. Accordingly, the amount of the one or more selected rare earth elements is set to be 27.0 to 35.0 wt %, and is preferably 28.0 to 32.0 wt % and more preferably 29.0 to 31.0 wt %.

Among the elements in R, Nd and Pr are satisfactory in the balance between the magnetic properties and are abundant as natural resources and relatively inexpensive, and hence it is preferable to select Nd and Pr as the main constituents for the rare earth elements. Dy and Tb exhibit large anisotropic magnetic fields, and are thereby effective in increasing the coercive force. Thus, it is preferable that Nd and/or Pr and Dy and/or Tb are selected as rare earth elements and the total of Nd and/or Pr content and Dy and/or Tb content is set to be 27.0 to 35.0 wt %. It is preferable that the contents of Dy and Tb are determined within the above described range depending on which of the residual magnetic flux density and the coercive force is to be regarded as important. In other words, when a high residual magnetic flux density is desired, the total content of Dy and Tb is preferably set to be 0.1 to 4.0 wt %, while when a high coercive force is desired, the total content of Dy and Tb is preferably set to be 4.0 to 12.0 wt %.

The R-T-B system permanent magnet of the present invention also preferably contains boron (B) in an amount of 0.5 to 2.0 wt %. When the content of B is less than 0.5 wt %, no high coercive force can be obtained, while when the content of B exceeds 2.0 wt %, the residual magnetic flux density tends to be decreased. Accordingly, the upper limit of the content of B is set at 2.0 wt %. The content of B is preferably 0.5 to 1.5 wt %, and more preferably 0.9 to 1.1 wt %.

The R-T-B system permanent magnet of the present invention is preferably set to have a content of oxygen (O) of 2500 ppm or less. When the content of O exceeds 2500 ppm, a part of the rare earth element(s) is strongly inclined to form oxide(s), and thus the content of the magnetically effective rare earth element(s) is reduced and the coercive force is thereby decreased. Thus, the content of O is preferably 2000 ppm or less, and more preferably 1500 ppm or less.

The R-T-B system permanent magnet of the present invention is preferably set to have a content of carbon (C) of 1500 ppm or less. When the content of C exceeds 1500 ppm, a part of the rare earth element(s) forms a carbide (carbides), and thus the content of the magnetically effective rare earth element(s) is reduced and the coercive force is thereby decreased. Thus, the content of C is preferably 1200 ppm or less, and more preferably 1000 ppm or less.

The R-T-B system permanent magnet of the present invention is preferably set to have a content of nitrogen (N) of 200 to 1500 ppm. By setting the content of N in the sintered body to fall within the above described range, an excellent corrosion resistance and high magnetic properties can be made compatible with each other. The content of N is more preferably 200 to 1000 ppm.

The R-T-B system permanent magnet of the present invention is allowed to comprise one or more of Nb: 0.1 to 2.0 wt %, Zr: 0.05 to 0.25 wt %, Al: 0.02 to 2.0 wt %, Co: 0.3 to 5.0 wt % and Cu: 0.01 to 1.0 wt %. These elements are regarded as the elements to replace a part of Fe.

Nb suppresses the growth of the grains when a sintered body with a low oxygen content is obtained, and has an improvement effect of the coercive force. Even when Nb is added excessively, the sinterabilities are not affected, but the degradation of the residual magnetic flux density becomes remarkable. Accordingly, the content of Nb is set to be 0.1 to 2.0 wt %. The content of Nb is preferably 0.3 to 1.5 wt %, and more preferably 0.3 to 1.0 wt %.

Zr is effective for the purpose of improving the magnetizabilities of the R-T-B system permanent magnet. Zr also displays an effect to suppress the abnormal growth of the grains in the course of the sintering and makes the structure of the sintered body uniform and fine when the oxygen content is reduced for the purpose of improving the magnetic properties of the R-T-B system permanent magnet. Accordingly, the effects of Zr become remarkable when the oxygen content is low. However, excessive addition of Zr degrades the sinterabilities. The content of Zr is preferably 0.05 to 0.20 wt %.

Al is effective in improving the coercive force, and also has an effect to extend the aging-treatment temperature range in which a high coercive force can be obtained. Also, when the R-T-B system permanent magnet of the present invention is produced on the basis of a mixing method to be described later, addition of Al to a high R alloy can improve the milling properties. However, excessive addition of Al causes the degradation of the residual magnetic flux density, and hence the content of Al is set to be 0.02 to 2.0 wt %. The content of Al is preferably 0.05 to 1.0 wt %, and more preferably 0.05 to 0.5 wt %.

Co is effective in improving the Curie temperature and the corrosion resistance. Addition of Co in combination of Cu provides an effect to extend the aging-treatment temperature range in which a high coercive force can be obtained. However, excessive addition of Co causes the degradation of the coercive force and also raises the cost, and hence the content of Co is set to be 0.3 to 5.0 wt %. The content of Co is preferably 0.3 to 3.0 wt %, and more preferably 0.3 to 1.0 wt %.

Similarly to Al, Cu is effective in improving the coercive force. Even a smaller content of Cu than that of Al displays an improvement effect of the coercive force, and Cu is different from Al in that the content to saturate the effect is lower in Cu than in Al. Excessive addition of Cu causes the degradation of the residual magnetic flux density, and hence the content of Cu is set to be 0.01 to 1.0 wt %. The content of Cu is preferably 0.01 to 0.5 wt %, and more preferably 0.02 to 0.2 wt %.

In the R-T-B system permanent magnet of the present invention, it is preferable that Co, Al and Cu are contained with the proviso that Co+Al+Cu≦1.0 wt % and the Co amount>the Al amount>the Cu amount, for the purpose of attaining a high coercive force while avoiding the degradation of the residual magnetic flux density caused by the addition of Al and Cu.

The present invention allows elements other than those mentioned above to be contained. For example, it is preferable for the present invention that Ga, Bi and Sn are appropriately contained. Ga, Bi and Sn are effective in improving the coercive force and the temperature properties of the coercive force. Excessive addition of these elements, however, causes the degradation of the residual magnetic flux density, and hence the content of these elements is preferably set to be 0.02 to 0.2 wt %. Also for example, one or more of Ti, V, Cr, Mn, Ta, Mo, W, Sb, Ge, Ni, Si and Hf may be contained.

<Production Method>

A preferred method of producing the R-T-B system permanent magnet according to the present invention will be described below.

A raw material alloy can be prepared by means of the strip casting method or other well known melting methods under vacuum or in an atmosphere of an inert gas, preferably in an atmosphere of Ar. This is also the case when the R-T-B system permanent magnet according to the present invention is produced by means of a so-called mixing method in which an alloy (low R alloy) containing the $R_2Fe_{14}B$ grains as the main component and an alloy (high R alloy) containing R in a larger amount than the low R alloy. In the case of the mixing method, the low R alloy may contain Cu and Al in addition to the rare earth element(s), Fe, Co and B, and the high R alloy may also contain Cu and Al in addition to the rare earth element(s), Fe, Co and B.

The raw material alloy is milled in a milling step. When the mixing method is adopted, the low R alloy and the high R alloy are milled separately or together. The milling step includes a crushing step and a pulverizing step. First, the raw material alloy is crushed until the particle size becomes of the order of a few 100 μm. The crushing is preferably conducted by use of a stamp mill, a jaw crusher, a Braun mill or the like in an atmosphere of an inert gas. It is effective to make the raw material alloy absorb hydrogen in advance of the crushing and to carry out milling by releasing the hydrogen. This hydrogen milling may be regarded as the crushing and the mechanical crushing may be omitted.

After the crushing step, the pulverizing step is conducted. A jet mill is mainly used in the pulverizing, in which the crushed powder of the order of a few 100 μm in particle size is made to have a mean particle size of 2 to 10 μm, and preferably 3 to 8 μm. Making the mean particle size of the pulverized powder fall within the above described ranges is preferable for the purpose of making the sum of the areas of the $R_2Fe_{14}B$ grains of 10 μm or less in grain size be 90% or more and making the sum of the areas of the $R_2Fe_{14}B$ grains of 20 μm or more in grain size be 3% or less. The jet mill involves a method in which milling is carried out in such a way that a high pressure inert gas is released from a narrow nozzle to generate a high speed gas flow, and the crushed powder is accelerated by the high speed gas flow to undergo mutual collision of the particles of the crushed powder, or undergo collision with a target or the wall of the vessel.

The R-T-B system permanent magnet of the present invention is regulated to have the content of O of 2500 ppm or less, and for that purpose, it is necessary to suppress the content increase of O in the pulverized powder in the jet mill. In this connection, in consideration of controlling the content of N to fall within the range specified in the present invention, it is recommended that the inert gas to be used in the jet mill is made to contain N as a main component. For example, the inert gas maybe N gas, or a mixed gas composed of N gas and Ar gas.

When the mixing method is adopted, no particular constraint is imposed on the timing of mixing together the two alloys; however, when the low R alloy and the high R alloy have been milled separately in the pulverizing step, the low R alloy powder and the high R alloy powder, both pulverized, are mixed together in an atmosphere of nitrogen. The mixing ratio of the low R alloy powder and the high R alloy powder may be set to be of the order of 80:20 to 97:3 by weight. The same mixing ratio is applied to the case where the low R alloy and the high R alloy are milled together. By adding a milling aid such as zinc stearate or the like in the pulverizing in a content of the order of 0.01 to 0.3 wt %, a fine powder having a high orientation can be obtained in the following compacting in a magnetic field.

The fine powder obtained as described above is compacted in a magnetic field. The compacting in a magnetic field may be carried out in a magnetic field of 960 to 1360 kA/m (12 to 17 kOe) and under a pressure of approximately 68.6 to 147 MPa (0.7 to 1.5 t/cm$^2$).

After the compacting in a magnetic field, the compacted body is sintered under vacuum or in an atmosphere of an inert gas. The sintering temperature needs to be adjusted to meet various conditions such as the composition, the milling method, the mean particle size and the particle size distribution; actually, the sintering may be carried out at 1000 to 1100° C. for 1 to 10 hours. The sintering conditions also constitute a factor for making the sum of the areas of the $R_2Fe_{14}B$ grains of 10 μm or less in grain size be 90% or more and making the sum of the areas of the $R_2Fe_{14}B$ grains of 20 μm or more in grain size be 3% or less. In advance of the sintering step, a treatment to remove the milling aid, gases or the like included in the compacted body may be carried out. After sintering, the obtained sintered body may be subjected to an aging treatment. This step is an important step to control the coercive force. When the aging treatment is conducted as two-stage treatment, a retention for a predetermined period of time in the vicinity of 800° C. and another retention for another predetermined period of time in the vicinity of 600° C. are effective. The heat treatment in the vicinity of 800° C. carried out after the sintering increases the coercive force, and is particularly effective in the mixing method. The heat treatment in the vicinity of 600° C. also increases the coercive force significantly, and accordingly it is recommended to carry out the aging treatment in the vicinity of 600° C. when the aging treatment is carried out as a one-stage treatment.

After the sintered body has been obtained, the above described overcoat is formed. The formation of the overcoat may be carried out according to methods well known in the art in conformity with the type of the overcoat. For example, when electrolytic plating is applied, there may be adopted a conventional method comprising the following operations: processing of the sintered body, barrel polishing, degreasing, water washing, etching (for example with nitric acid), water washing, deposition by electrolytic plating, water washing and drying. Here, by regulating the conditions of the etching and electrolytic plating, the thickness of the hydrogen-rich layer can be controlled.

Next, the present invention will be described below in more detail with reference to specific examples.

EXAMPLE 1-1-1

A thin strip alloy having a predetermined composition was prepared by means of the strip casting method. The thin strip alloy was made to absorb hydrogen at room temperature, and thereafter, the absorbed hydrogen was released by raising the temperature up to approximately 400 to 700° C. in an atmosphere of Ar to yield a coarse powder.

The coarse powder was pulverized by use of a jet mill. The pulverizing was carried out in such a way that the inside of the jet mill was purged with $N_2$ gas and thereafter a high pressure $N_2$ gas flow was used. The content of $O_2$ in the high pressure $N_2$ gas was at a level to be regarded as substantially null. The mean particle size of the obtained fine powder was 4.0 μm. It is to be noted that zinc stearate was added before pulverizing as a milling aid in a content of 0.01 to 0.10 wt % and the content of the residual carbon in the sintered body was controlled.

The obtained fine powder was compacted in a magnetic field of 1200 kA/m (15 kOe) under a pressure of 98 MPa (1.0 ton/cm$^2$) to yield a compacted body. The compacted body was sintered under vacuum at 1030° C. for 4 hours, and thereafter quenched. The obtained sintered body was then subjected to a two-stage aging treatment in which the first stage at 850° C. for 1 hour and the second stage at 540° C. for 1 hour were carried out (both steps in the atmosphere of Ar). The compositions of a plurality of sintered bodies prepared as described above were analyzed to yield the results shown in FIG. 4.

For each of the obtained sintered bodies, the sum of the areas of the $R_2Fe_{14}B$ grains of 10 μm or less in grain size and the sum of the areas of $R_2Fe_{14}B$ grains of 20 μm or more in grain size in relation to the total area of the $R_2Fe_{14}B$ grains were measured to obtain the results shown in FIG. 5.

The magnetic properties of each of the sintered bodies were measured to obtain the results as shown in FIG. 5.

Each of the sintered bodies was machined to dimensions of 20 mm×20 mm×7 mm (the direction of the axis of easy magnetization), and thereafter, the surface thereof was subjected to Ni plating in a thickness of 10 μm. The Ni plating was formed electrolytic plating according to the above described conventional method. The sintered bodies based on the composition A were varied in the thickness of the hydrogen-rich layer by varying the current density in electrolytic plating. In each of the sintered bodies, the thickness of the hydrogen-rich layer was measured in such a way that after peeling off the overcoat, the surface of the body was scraped stepwise, and the hydrogen content of the powder obtained at each step of scraping was plotted against the depth of scraping. The peeling off of the overcoat and the stepwise scraping of the surface of the body were carried out in an atmosphere of an inert gas.

The upper limit of the content of hydrogen in the hydrogen-rich layer was 4000 ppm.

Then, the samples (each sample comprising 100 specimens) were allowed to stand under the conditions of a pressure of 2 atm, a temperature of 120° C. and a humidity of 100%. The samples were released 1500 hours later from the conditions, and the presence and absence of abnormal states (swelling and exfoliation of the plating) of the samples were checked by visual inspection. The results (in each sample, the number of the specimens found to have abnormal states) thus obtained are shown in FIG. 5.

As can be seen from FIG. 5, as compared to the case where no hydrogen-rich layer is present, the corrosion resistance was improved as the thickness of the hydrogen-rich layer was increased to 20 μm and 40 μm, but the corrosion resistance was degraded as the thickness of the hydrogen-rich layer exceeded 40 μm and was further increased, and the corrosion resistance was of the same order as that without any hydrogen-rich layer when the thickness reached 300 μm. From these results, it has been found that the presence of a hydrogen-rich layer having a predetermined thickness can improve the corrosion resistance when a Ni plating is provided as an overcoat.

EXAMPLE 1-1-2

In the same manner as in Example 1-1-1 (except that oleic acid amide was added as a milling aid in a content of 0.05 to 0.20 wt % before pulverizing), the sintered magnets having the compositions shown in FIG. 6 were prepared, and the corrosion resistance was evaluated and the magnetic properties were measured for each of the sintered magnets. Also, in the same manner as in Example 1-1-1, the sum of the areas of the $R_2Fe_{14}B$ grains of 10 μm or less in grain size and the sum of the areas of the $R_2Fe_{14}B$ grains of 20 μm or more in grain size in relation to the total area of the main phase were measured for each of the sintered magnets. The results thus obtained are shown in FIG. 7.

As shown in FIG. 7, sample No. 19 having a content of N as low as 100 ppm was worse in corrosion resistance than sample No. 18; and sample No. 20 having a content of N as large as 1800 ppm was low in coercive force. Thus, the content of N needs to be controlled to fall within a predetermined range for the purpose of simultaneously acquiring a corrosion resistance and magnetic properties.

Sample No. 21 having a content of O as large as 3000 ppm and sample No. 22 having a content of C as large as 1800 ppm are both lower in coercive force than sample No. 18. Thus, the contents of O and C each need to be controlled to fall within a predetermined composition range for the purpose of ensuring magnetic properties.

Sample No. 23 having a content of Nd as large as 32.8 wt % is remarkably worse in corrosion resistance. Thus, it has been verified that the content of Nd (a rare earth element) is preferably set to be as low as possible for the purpose of ensuring the corrosion resistance.

In above Examples, examples adopting Ni plating as the overcoat have been described, but the present invention is, needless to say, effective for the cases where plating with the above described other materials or overcoats based on other methods are used for covering.

EXAMPLE 1-2

A thin strip alloy having a predetermined composition was prepared by means of the strip casting method. The thin strip alloy was made to absorb hydrogen at room temperature, and thereafter, the absorbed hydrogen was released by raising the temperature up to approximately 400 to 700° C. in an atmosphere of Ar to yield a coarse powder.

The coarse powder was pulverized by use of a jet mill. The pulverizing was carried out in such a way that the inside of the jet mill was purged with $N_2$ gas and thereafter a high pressure $N_2$ gas flow was used. The mean particle size of the obtained fine powder was 4.0 μm. It is to be noted that zinc stearate was added before pulverizing as a milling aid in a content of 0.05 wt %.

The obtained fine powder was compacted in a magnetic field of 1200 kA/m (15 kOe) under a pressure of 98 MPa (1.0 ton/cm$^2$) to yield a compacted body. The compacted body was sintered under vacuum at 1030° C. for 4 hours, and thereafter quenched. The obtained sintered body was then subjected to a two-stage aging treatment in which the first stage at 850° C. for 1 hour and the second step at 540° C. for 1 hour were carried out (both steps in the atmosphere of Ar). The composition of the sintered body was analyzed to yield the results shown in FIG. 8. The measurement results of the magnetic properties of the sintered body are also collected in FIG. 8.

From a plurality of the sintered bodies prepared as described above, rectangular samples each having dimensions of A (mm)×B (mm)×C (mm) were prepared. The samples were subjected to a barrel polishing treatment and an acid etching treatment, and thereafter electrolytic plating was applied. The conditions for the acid etching and the electrolytic plating are as shown in FIG. 9. The plating bath was as described below.

The dimensions of A, B and C were measured before the barrel polishing treatment, after the barrel polishing treatment, after the etching treatment and after the electrolytic plating treatment (n=10). The results thus obtained are shown in FIGS. 11 to 15 (respectively corresponding to samples Nos. 24 to 28). In FIGS. 11 to 15, the measured values are listed randomly; from these results, standard deviations were derived and the results of this derivation are shown in FIG. 10.

After the plating treatment, in each sample, the plating coat was peeled off, and then a certain thickness of layer was scraped repeatedly from the surface of the sample and each of the scraped layers was subjected to gas analysis. The results thus obtained are collected in FIG. 10. The peeling off of the overcoat and the scraping of the surface were conducted in an atmosphere of an inert gas. The hydrogen concentrations in the surfaces of the bodies shown in FIG. 10 were the values measured for the samples each obtained by scraping an about 10 μm thick layer from the surface of the body concerned.

[Plating bath (Watt bath)]

Nickel sulfate hexahydrate: 295 g/liter

Nickel chloride hexahydrate: 45 g/liter

Boric acid: 45 g/liter

Sodium 1,3,6-naphthalene-trisulfonate: 4 g/liter

2-Butyne-1,4-diol: 0.2 g/liter

As can be seen from FIG. 10, sample Nos. 26 and 27 are larger in the standard deviations for the dimensions of A to C after acid etching and after plating treatment and are worse in dimensional precision than sample Nos. 24 and 25. In sample No. 24 having a hydrogen concentration of 450 ppm in the surface of the magnet body and having a 50 μm thick hydrogen-rich layer and sample No. 25 having a hydrogen concentration of 720 ppm in the surface of the magnet body and having a 250 μm thick hydrogen-rich layer, the standard deviations of the dimensions A to C after the acid etching and after the plating treatment are not significantly different from those before these treatments. On the contrary, in sample No. 26 having a hydrogen concentration of 120 ppm in the surface of the magnet body and having a 0 μm thick hydrogen-rich layer and sample No. 27 having a hydrogen concentration of 1200 ppm in the surface of the magnet body and having a 240 μm thick hydrogen-rich layer, the standard deviations of the dimensions A to C after the acid etching and after the plating treatment are seen to be considerably worse than those before these treatments. In other words, the dimensional precision becomes worse when the hydrogen concentration in the surface of the body is 120 ppm and no hydrogen-rich layer is present, or when on the contrary the hydrogen concentration in the surface of the body is as high as 1200 ppm. Also as in sample No. 28, even in the case where the hydrogen concentration falls within a range from 300 to 1000 ppm, the dimensional precision becomes worse when the thickness of the hydrogen-rich layer is as thick as 450 μm.

EXAMPLE 2-1

A thin strip alloy having a predetermined composition was prepared by means of the strip casting method. The thin strip alloy was made to absorb hydrogen at room temperature, and thereafter, the absorbed hydrogen was released by raising the temperature up to approximately 400 to 700° C. in an atmosphere of Ar to yield a coarse powder.

The coarse powder was pulverized by use of a jet mill. The pulverizing was carried out in such a way that the inside of the jet mill was purged with $N_2$ gas and thereafter a high pressure $N_2$ gas flow was used. The mean particle size of the obtained fine powder was 4.0 μm. It is to be noted that zinc stearate was added before pulverizing as a milling aid in a content of 0.01 to 0.10 wt %.

The obtained fine powder was compacted in a magnetic field of 1200 kA/m (15 kOe) under a pressure of 98 MPa (1.0 ton/cm$^2$) to yield a compacted body. The compacted body was sintered under vacuum at 1030° C. for 4 hours, and thereafter quenched. The obtained sintered body was then subjected to a two-stage aging treatment in which the first stage at 850° C. for 1 hour and the second stage at 540° C. for 1 hour were carried out (both steps in the atmosphere of Ar). The compositions of a plurality of sintered bodies prepared as described above were analyzed to yield the results shown in FIG. 16.

The magnetic properties of each of the sintered bodies were measured to yield the results as shown in FIG. 17.

Each of the sintered bodies was machined to dimensions of 20 mm×20 mm×7 mm (the direction of the axis of easy magnetization); and thereafter, a 10 μm thick Ni plating was formed on each of samples 29 to 46, a 5 μm thick Cu plating and a 5 μm thick Ni plating were successively formed on sample No. 47, and a 5 μm thick Cu plating, a 5 μm thick Ni plating and a 1 μm thick Sn plating were successively formed on sample No. 48. These individual plating coats were formed by use of the below described Watt bath and by means of an electrolytic plating method based on the below described conditions.

[Watt bath]

Composition of plating solution:

Nickel sulfate hexahydrate: 280 g/l

Nickel chloride hexahydrate: 40 g/l

Boric acid: 40 g/l

Sodium naphthalene disulfonate: 2 g/l

2-Butyne-1,4-diol: 0.1 g/l pH: 4

[Plating conditions]

Sample No. 29: Plating at a current density of 0.2 A/dm$^2$ (bath temperature: 35° C.) for 300 minutes Sample No. 30: Plating at a current density of 0.4 A/dm$^2$ (bath temperature: 35° C.) for 150 minutes Sample No. 31: Plating at a current density of 0.6 A/dm$^2$ (bath temperature: 50° C.) for 100 minutes Sample No. 32: Plating at a current density of 1.0 A/dm$^2$ (bath temperature: 50° C.) for 60 minutes Sample No. 33: Plating at a current density of 1.5 A/dm$^2$ (bath temperature: 50° C.) for 40 minutes Sample No. 34: Plating at a current density of 3.0 A/dm$^2$ (bath temperature: 50° C.) for 20 minutes Sample No. 35: Plating at a current density of 5.0 A/dm$^2$ (bath temperature: 60° C.) for 15 minutes Sample No. 36: Plating at a current density of 8.0 A/dm$^2$ (bath temperature: 60° C.) for 8 minutes Other samples: Plating at current density of 0.5 to 3.0 A/dm$^2$ for 200 to 20 minutes The analysis of the absolute value of the content of hydrogen in the hydrogen-rich layer in each sample was carried out as follows: the plating coat was peeled off, and then a certain thickness of layer was scraped repeatedly from the surface of the sample and each of the scraped layers was subjected to gas analysis. The results thus obtained are also shown in FIG. 17. The peeling off of the overcoat and the scraping of the surface were conducted in an atmosphere of an inert gas. The upper limit of the content of hydrogen in the hydrogen-rich layer was of the order of 4000 ppm.

The profile of the hydrogen concentration in each of sample Nos. 29 to 46 was observed. The observation concerned was carried out by surface analysis based on SIMS (Secondary Ion Mass Spectrometry) as applied to an obliquely ground sample surface with a predetermined inclination angle in relation to the thickness direction of the plating coat. Consequently, as shown in FIG. 17, the following facts were verified: sample Nos. 30 to 46 each showed a profile in which the hydrogen concentration was continuously decreased from the surface of the magnet body toward the inside of the magnet body, and the hydrogen concentration in the region concerned was higher than that in the central portion of the magnet body (equivalent to the hydrogen concentration at a position of 500 μm from the surface); on the contrary, sample No. 29 showed a hydrogen concentration approximately uniform over the whole magnet body.

Then, a thermal shock test was carried out for sample Nos. 29 to 48. More specifically, the thermal shock test was conducted by repeating 100 times the procedure cycle in which a sample was maintained at −40° C. in the air for 30 minutes, and then heated up to 110° C. and maintained at that temperature for 30 minutes. Before and after the thermal shock test, samples (each containing 10 specimens) were subjected to the peeling off strength measurement of the plating coat. The results obtained are collected in FIG. 17. The peeling off strengths of the plating coats were measured by means of a plating adhesive strength tester manufactured by YAMAMOTO-MS Co., Ltd.

Sample Nos. 29 to 48 were further subjected to a corrosion resistance test. In the corrosion resistance test, samples (each containing 100 specimens) were allowed to stand in an environment of a pressure of 2 atm, a temperature of 120° C. and a humidity of 100%. The samples were released 1500 hours later from the environment and the presence and absence of abnormal states (swelling and exfoliation of the plating) of the samples were checked by visual inspection. The results (in each sample, the number of the specimens found to have abnormal states) thus obtained are shown in FIG. 17.

AS can be seen from FIG. 17, when there was shown a profile in which the hydrogen concentration was decreased continuously from the surface of the magnet body toward the inside of the magnet body, the adhesiveness of the plating coat after the thermal shock test was high.

As can also be seen, the corrosion resistance was improved as the thickness of the hydrogen-rich layer exhibiting a hydrogen concentration of 1000 ppm or more was increased to 20 μm and 40 μm, but the corrosion resistance was degraded as the thickness of the hydrogen-rich layer exhibiting a hydrogen concentration of 1000 ppm or more exceeded 100 μm and was further increased; when the thickness of the hydrogen-rich layer exhibiting a hydrogen concentration of 1000 ppm or more exceeded 300 μm, the corrosion resistance was of the same order as that without the hydrogen-rich layer exhibiting a hydrogen concentration of 1000 ppm or more.

From the above results, it has been found that the degradation of the adhesiveness of the plating coat after undergoing thermal shock can be suppressed and the corrosion resistance can be thereby improved, by making the hydrogen concentration profile take a form in which the hydrogen concentration is continuously decreased from the surface of the magnet body toward the inside of the magnet body through controlling the plating coat formation conditions and by further setting the thickness of the hydrogen-rich layer exhibiting a hydrogen concentration of 1000 ppm or more to fall within a predetermined range.

Now, it is understood from FIG. 17 that the above described results also hold for the cases of the R-T-B system permanent magnets having the compositions other than the composition A and additionally for the cases where plating other than Ni plating was applied.

EXAMPLE 2-2

A thin strip alloy having a predetermined composition was prepared by means of the strip casting method. The thin strip alloy was made to absorb hydrogen at room temperature, and thereafter, the absorbed hydrogen was released by raising the temperature up to approximately 400 to 700° C. in an atmosphere of Ar to yield a coarse powder.

The coarse powder was pulverized by use of a jet mill. The pulverizing was carried out in such a way that the inside of the jet mill was purged with $N_2$ gas and thereafter a high pressure $N_2$ gas flow was used. The mean particle size of the obtained fine powder was 4.0 μm. It is to be noted that zinc stearate was added before pulverizing as a milling aid in a content of 0.01 to 0.10 wt %.

The obtained fine powder was compacted in a magnetic field of 1200 kA/m (15 kOe) under a pressure of 98 MPa (1.0 ton/cm$^2$) to yield a compacted body. The compacted body was sintered under vacuum at 1030° C. for 4 hours, and thereafter quenched. The obtained sintered body was then subjected to a two-stage aging treatment in which the first stage at 850° C. for 1 hour and the second stage at 540° C. for 1 hour were carried out (both steps in the atmosphere of Ar). The compositions of a plurality of sintered bodies prepared as described above were analyzed to yield the results shown in FIG. 18.

The magnetic properties of each of the sintered bodies were measured to yield the results as shown in FIG. 19.

Each of the sintered bodies was machined to dimensions of 20 mm×20 mm×7 mm (the direction of the axis of easy magnetization), and thereafter, the surface thereof was subjected to electrolytic plating. For the purpose of successively and stepwise decreasing the hydrogen concentration from the magnet body as in the present invention, plating may be made, for example, with a deposition rate of the plating coat decreasing successively and stepwise from the surface of the magnet body. In other words, by making higher the deposition rate of the plating coat, the hydrogen concentration of the hydrogen-rich layer can be made larger. The deposition rate of the coat can be varied by varying the current density in the plating bath. The hydrogen concentration can also be varied by use of an additive (a brightener). More specifically, plating was carried out according to the following conditions 1 to 7.

Condition 1

A barrel plating was carried out by use of a Watt bath having the below described composition. In this plating bath, there were carried out a run of deposition at a current density of 7 A/dm$^2$ for 25 minutes and successively another run at 4 A/dm$^2$ for 70 minutes. In both runs, the bath temperature was 60° C.

Condition 2

A barrel plating was carried out by use of a sulfamic acid bath having the below described composition. In this plating bath, there were carried out a run of deposition at a current density of 8 A/dm$^2$ for 30 minutes, successively another run at 5 A/dm$^2$ for 50 minutes, and yet another run at 3 A/dm$^2$ for 50 minutes. In all the runs, the bath temperature was 60° C.

Condition 3

A barrel plating was carried out by use of the Watt bath having the below described composition. In this plating bath, there were carried out a run of deposition at a current density of 7 A/dm$^2$ for 30 minutes, successively another run at 5 A/dm$^2$ for 90 minutes, yet another run at 3 A/dm$^2$ for 60 minutes and further yet another run at 7 A/dm$^2$ for 30 minutes. In all the runs, the bath temperature was 60° C.

Condition 4

A barrel plating was carried out by use of the Watt bath having the below described composition. In this plating bath, a run of deposition was carried out at a current density of 5 A/dm$^2$ for 30 minutes. The bath temperature was 60° C.

Condition 5

A barrel plating was carried out by use of the Watt bath having the below described composition. In this plating bath, a run of deposition was carried out at a current density of 5 A/dm$^2$ for 150 minutes. The bath temperature was 60° C.

Condition 6

A barrel plating was carried out by use of the Watt bath having the below described composition. In this plating bath, a run of deposition was carried out at a current density of 5 A/dm$^2$ for 210 minutes. The bath temperature was 60° C.

Condition 7

A barrel plating was carried out by use of the Watt bath having the below described composition. In this plating bath, a run of deposition was carried out at a current density of 0.2 A/dm$^2$ for 750 minutes. The bath temperature was 35° C.

[Watt bath]

Composition of plating solution:

Nickel sulfate hexahydrate: 280 g/l

Nickel chloride hexahydrate: 40 g/l

Boric acid: 40 g/l

Sodium naphthalene disulfonate: 2 g/l

2-Butyne-1,4-diol: 0.1 g/l pH: 4

[Sulfamic acid bath]

Composition of plating bath:

Nickel sulfamate tetrahydrate: 300 g/l

Nickel chloride hexahydrate: 30 g/l

Boric acid: 30 g/l

Sodium laurylsulfate: 0.8 g/l pH: 4.5

The analysis of the absolute value of the content of hydrogen in the hydrogen-rich layer in each sample was carried out as follows: the plating coat was peeled off, and then a certain thickness of layer was scraped repeatedly from the surface of the sample and each of the scraped layers was subjected to gas analysis. The results thus obtained are also shown in FIG. 19. The peeling off of the overcoat and the scraping of the surface were conducted in an atmosphere of an inert gas. The upper limit of the content of hydrogen in the hydrogen-rich layer was of the order of 4000 ppm.

The profile of the hydrogen concentration in each of sample Nos. 49 to 55 was observed. The observation concerned was carried out by surface analysis based on SIMS (Secondary Ion Mass Spectrometry) as applied to an obliquely ground sample surface with a predetermined inclination angle in relation to the thickness direction of the plating coat. Consequently, as shown in FIG. 19, sample Nos. 49 to 54 each showed a profile in which the hydrogen concentration was stepwise decreased from the surface of the magnet body toward the inside of the magnet body, whereas sample No. 55 showed a hydrogen concentration of the order of 8.0 ppm and approximately uniform from the central portion of the magnet body to the surface layer portion thereof. In FIG. 19, in each sample, the first layer was situated on the outermost side of the magnet body and the second to other successive layers, if any, were situated inside, and the first layer had a hydrogen concentration of 1000 ppm or more.

Then, a thermal shock test was carried out for sample Nos. 49 to 55. More specifically, the thermal shock test was conducted by repeating 100 times the procedure cycle in which a sample was maintained at −40° C. in the air for 30 minutes, and then heated up to 110° C. and maintained at that temperature for 30 minutes. Before and after the thermal shock test, samples (each containing 10 specimens) were subjected to the peeling off strength measurement of the plating coat. The results obtained are collected in FIG. 20. The peeling off strengths of the plating coats were measured by means of a plating adhesive strength tester manufactured by YAMAMOTO-MS Co., Ltd.

Sample Nos. 49 to 55 were further subjected to a corrosion resistance test. In the corrosion resistance test, samples (each containing 100 specimens) were allowed to stand in an environment of a pressure of 2 atm, a temperature of 120° C. and a humidity of 100%. The samples were released 2000 hours later from the environment and the presence and absence of abnormal states (swelling and exfoliation of the plating) of the samples were checked by visual inspection. The results (in each sample, the number of the specimens found to have abnormal states) thus obtained are shown in FIG. 20.

As can be seen from FIG. 20, when there was the hydrogen-rich layer in the surface layer portion of the magnet body and there was shown a profile in which the hydrogen concentration was decreased stepwise from the surface of the magnet body toward the inside of the magnet body, the adhesiveness of the plating coat after the thermal shock test was high.

When the thickness of the hydrogen-rich layer becomes thick, the corrosion resistance tends to be degraded, and hence it is preferable that the thickness of the hydrogen-rich layer is set to be 300 μm or less form the viewpoint of the corrosion resistance.

From the above results, it has been found that the degradation of the adhesiveness of the plating coat after undergoing thermal shock can be suppressed and the corrosion resistance can be thereby improved, by making the hydrogen concentration profile take a form in which the hydrogen concentration is stepwise decreased from the surface of the magnet body toward the inside of the magnet body through controlling the plating coat formation conditions and by further setting the thickness of the hydrogen-rich layer exhibiting a hydrogen concentration of 1000 ppm or more to fall within a predetermined range.

INDUSTRIAL APPLICABILITY

According to the present invention, a preferable state of the contained hydrogen for the R-T-B system permanent magnet is proposed; more specifically, the corrosion resistance of the R-T-B system permanent magnet with an overcoat formed thereon can be improved without degrading the magnetic properties; and the present invention can be applied to formation of the overcoat by electrolytic plating, can fully ensure the corrosion resistance as a primary target of the overcoat formation without substantially degrading the production efficiency, and can provide the R-T-B system permanent magnet with a high dimensional precision by suppressing the partial collapse (detachment of grains) of the surface thereof.

The invention claimed is:

1. An R-T-B system permanent magnet characterized by comprising:

a magnet body comprising a sintered body comprising at least a main phase comprising $R_2T_{14}B$ grains (wherein R represents one or more rare earth elements, and T represents one or more transition metal elements including Fe or Fe and Co essentially) and a grain boundary phase containing R in a larger amount than the main phase, the magnet body having a 10-200 μm thick hydrogen-rich layer having a hydrogen concentration of 300 ppm or more formed in the surface layer portion; and an overcoat covering the surface of the magnet body.

2. The R-T-B system permanent magnet according to claim 1, characterized in that the hydrogen-rich layer has a hydrogen concentration of 1000 ppm or more.

3. The R-T-B system permanent magnet according to claim 1, characterized in that:

said sintered body comprises at least a main phase comprising $R_2Fe_{14}B$ grains and a grain boundary phase comprising R in a larger amount than the main phase; and the sum of the areas of the $R_2Fe_{14}B$ grains of 10 μm or less in grain size is 90% or more, and the sum of areas of the $R_2Fe_{14}B$ grains of 20 μm or more in grain size is 3% or less, in relation to the total area of the main phase.

4. The R-T-B system permanent magnet according to claim 1, characterized in that the magnet body comprises a sintered body having a composition comprising R: 27.0 to 35.0 wt % (wherein R represents one or more rare earth elements), B: 0.5 to 2.0 wt %, O: 2500 ppm or less, C: 1500 ppm or less, N: 200 to 1500 ppm, and the balance substantially being Fe.

5. The R-T-B system permanent magnet according to claim 4, characterized in that the sintered body comprises one or more of Nb: 0.1 to 2.0 wt %, Zr: 0.05 to 0.25 wt %, Al: 0.02 to 2.0 wt %, Co: 0.3 to 5.0 wt % and Cu: 0.01 to 1.0 wt %.

6. The R-T-B system permanent magnet according to claim 1, characterized in that the hydrogen-rich layer has a hydrogen concentration of 300 to 1000 ppm.

7. The R-T-B system permanent magnet according to claim 1, characterized in that the overcoat is formed by electrolytic metal plating.

8. The R-T-B system permanent magnet according to claim 2, characterized in that the hydrogen-rich layer has a hydrogen concentration decreased from the surface of the magnet body toward the inside of the magnet body.

9. The R-T-B system permanent magnet according to claim 8, characterized in that the hydrogen-rich layer has a hydrogen concentration continuously decreased from the surface of the magnet body toward the inside of the magnet body.

10. The R-T-B system permanent magnet according to claim 8, characterized in that the hydrogen-rich layer has a hydrogen concentration stepwise decreased from the surface of the magnet body toward the inside of the magnet body.

11. The R-T-B system permanent magnet according to claim 8, characterized in that the overcoat is formed by electrolytic metal plating.

* * * * *